US008282091B2

(12) United States Patent
Furuhashi et al.

(10) Patent No.: US 8,282,091 B2
(45) Date of Patent: Oct. 9, 2012

(54) SPINE FORMATION DEVICE, BOOKBINDING SYSTEM, AND SPINE FORMATION METHOD

(75) Inventors: Tomohiro Furuhashi, Fujisawa (JP); Shinji Asami, Machida (JP); Nobuyoshi Suzuki, Tokyo (JP); Naohiro Kikkawa, Kawasaki (JP); Kazuhiro Kobayashi, Kawasaki (JP); Kiichiroh Gotoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 12/923,983

(22) Filed: Oct. 19, 2010

(65) Prior Publication Data

US 2011/0103919 A1 May 5, 2011

(30) Foreign Application Priority Data

Oct. 30, 2009 (JP) ..... 2009-250815
Feb. 22, 2010 (JP) ..... 2010-035987

(51) Int. Cl.
*B31F 1/08* (2006.01)

(52) U.S. Cl. ..... 270/45; 270/58.07

(58) Field of Classification Search ..... 270/32, 270/45, 51, 58.07; 412/22, 26; 493/442, 493/454
See application file for complete search history.

(56) References Cited

U.S. PATENT DOCUMENTS

| | | | | |
|---|---|---|---|---|
| 6,692,208 | B1 * | 2/2004 | Watkiss et al. | 412/1 |
| 7,431,273 | B2 * | 10/2008 | Kamiya et al. | 270/37 |
| 2003/0031532 | A1 * | 2/2003 | Nolte et al. | 412/33 |
| 2005/0008460 | A1 * | 1/2005 | Watkiss | 412/9 |
| 2007/0120310 | A1 * | 5/2007 | Awano | 270/45 |
| 2009/0137374 | A1 | 5/2009 | Kobayashi et al. | |
| 2009/0152789 | A1 | 6/2009 | Kikkawa et al. | |
| 2009/0200725 | A1 | 8/2009 | Tamura et al. | |
| 2009/0258774 | A1 | 10/2009 | Suzuki et al. | |
| 2010/0239393 | A1 | 9/2010 | Suzuki et al. | |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |
| 2011/0103921 | A1 | 5/2011 | Suzuki et al. | |

FOREIGN PATENT DOCUMENTS

| | | |
|---|---|---|
| EP | 1 790 493 | 5/2004 |
| EP | 1 479 528 | 11/2004 |
| JP | 2001-260564 | 9/2001 |
| JP | 2007-237562 | 9/2007 |

OTHER PUBLICATIONS

Europe Search Report dated Jan. 28, 2011 issued in corresponding European Application No. 10251819.8.

* cited by examiner

*Primary Examiner* — Leslie A Nicholson, III
(74) *Attorney, Agent, or Firm* — Harness, Dickey & Pierce, P.L.C.

(57) ABSTRACT

A spine formation device includes a sheet conveyer, a clamping unit disposed downstream from the sheet conveyer in a sheet conveyance direction, for squeezing a folded portion of a bundle of folded sheets, a contact member against which the folded portion of the bundle is pressed, disposed downstream from the clamping unit, and a controller to cause the bundle of folded sheets to bulge by stopping the sheet conveyer after the bundle of folded sheets is transported a predetermined conveyance distance from a contact position between the contact member and the folded portion of the bundle and to cause the clamping unit to squeeze a bulging portion of the bundle created between the sheet conveyer and the contact member with the folded portion pressed against the contact member. The predetermined distance is set in accordance with a predetermined sheet-related variable.

10 Claims, 18 Drawing Sheets

SPINE FORMATION DEVICE, BOOKBINDING SYSTEM, AND SPINE FORMATION METHOD

CROSS-REFERENCE TO RELATED APPLICATIONS

This patent specification is based on and claims priority from Japanese Patent Application Nos. 2009-250815, filed on Oct. 30, 2009 in the Japan Patent Office and 2010-035987, filed on Feb. 22, 2010 in the Japan Patent Office, which are hereby incorporated by reference herein in their entirety.

BACKGROUND OF THE INVENTION

1. Field of the Invention

The present invention generally relates to a spine formation device to form a spine of a bundle of folded sheets, a bookbinding system including the spine formation device and an image forming apparatus, such as a copier, a printer, a facsimile machine, or a multifunction machine capable of at least two of these functions, and a spine formation method.

2. Description of the Background Art

At present, saddle-stitching or saddle-stapling, that is, stitching or stapling a bundle of sheets along its centerline is widely used as a simple bookbinding method. Typically, the spine of the bundle of sheets (hereinafter "a booklet") produced through saddle-stitching bookbinding tends to bulge as a result of being folded along its centerline. It is preferred to reduce such bulging of the spine of the booklet, that is, to flatten the spine of the booklet, to improve its appearance and to facilitate stacking, storage, and transport of the booklet.

More specifically, when a bundle of sheets is saddle-stitched or saddle-stapled and then folded in two, the folded portion around its spine tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

By contrast, when the spine of the booklet is flattened, bulging of the booklet can be reduced, and accordingly multiple booklets can be piled together. This flattening is important for ease of storage and transport because it is difficult to stack booklets together if their spines bulge, making it difficult to store or carry them. With this reformation, relatively large number of booklets can be piled together. It is to be noted that the term "spine" used herein means not only the stitched side of the booklet but also portions of the front cover and the back cover continuous with the spine.

In view of the foregoing, for example, the following approaches have been proposed to flatten the spine of the booklet.

For example, in JP-2001-260564-A, the spine of the booklet is flattened using a pressing member configured to clamp an end portion of the booklet adjacent to the spine and a spine-forming roller configured to roll on longitudinally while contacting the spine of the booklet. The spine-forming roller moves at least once over the entire length of the spine of the booklet fixed in place by the pressing member while applying to the spine a pressure sufficient to flatten the spine.

Although this approach can flatten the spine of the booklet to a certain extent, it is possible that the sheets might wrinkle and be torn around the spine or folded portion because the pressure roller applies localized pressure to the spine continuously. Further, it takes longer to flatten the spine because the pressure roller must move over the entire length of the spine of the booklet.

Therefore, for example, in JP-2007-237562-A, the spine of the booklet is flattened using a spine pressing plate pressed against the spine of the booklet, a clamping member that clamps the bundle of folded sheets from the front side and the back side of the booklet, and a pressure member to squeeze the spine from opposing sides of the booklet in the direction of the thickness of the booklet to reduce bulging of the spine.

However, because only the bulging portion is pressed with the spine-forming roller in the first approach, the booklet can wrinkle in a direction perpendicular to the longitudinal direction in which the spine extends, degrading its appearance. In addition, with larger sheet sizes, productivity decreases because it takes longer for the spine-forming roller to move over the entire length of the spine of the booklet. At present, it is important to operate such spine formation devices efficiently to reduce energy consumption. Generally, when efficiency is considered, processing conditions such as the degree of pressure and the number of repetitions vary depending on the quantity of sheets, sheet thickness, and sheet type. However, in the first approach using the spine-forming roller, only the number of times the spine-forming roller moves the entire length of the spine of the booklet can be adjusted, and thus it is difficult to make processing more efficient.

In addition, although the second approach can reduce the occurrence of wrinkles in and damage to the booklet caused by the first method described above, the processing time can still be relatively long because the clamping member, the pressure member, and so forth are all operated consecutively and not simultaneously after the booklet is pressed against the spine pressing plate.

In addition, the device according to the second approach described above is bulky because a motor is necessary to move the spine pressing plate in a reverse direction of the sheet conveyance direction. Moreover, a relatively large driving force is necessary because the bulging is formed by pressing the booklet a relatively short distance between the spine pressing plate and the clamping member with the spine pressing plate, increasing the power consumption, which is not desirable.

In view of the foregoing, the inventors of the present invention recognize that there is a need to reliably reduce bulging of booklets, regardless of the thickness of the booklet or the number of sheets, while reducing damage to the booklet, which known approaches fail to do.

SUMMARY OF THE INVENTION

In one illustrative embodiment of the present invention, a spine formation device for forming a spine of a bundle of folded sheets includes a sheet conveyer that conveys the bundle of folded sheets with a folded portion of the bundle forming a front end portion of the bundle, a clamping unit disposed downstream from the sheet conveyer in a sheet conveyance direction in which the bundle of folded sheets is transported, for squeezing the folded portion of the bundle in a direction of thickness of the bundle, a contact member disposed downstream from the clamping unit in the sheet conveyance direction and including a flat contact surface against which the folded portion of the bundle is pressed, and a controller comprising a CPU and operatively connected to the sheet conveyer as well as the clamping unit.

The controller causes the bundle of folded sheets to bulge by stopping the sheet conveyer after the bundle of folded sheets is transported a predetermined conveyance distance downstream in the sheet conveyance direction from a contact position between the contact member and the folded portion of the bundle and causes the clamping unit to squeeze a bulging portion of the bundle created between the sheet conveyer and the contact member with the folded portion pressed against the contact member. The predetermined distance is set in accordance with a predetermined sheet-related variable.

Another illustrative embodiment provides a bookbinding system that includes an image forming apparatus to form images on sheets of recording media and the spine formation device described above.

Yet another illustrative embodiment provides a spine formation method used in the spine formation device described above. The spine formation method includes transporting the bundle of folded sheets with the folded portion of the bundle forming a front end portion of the bundle in the sheet conveyance direction, causing the bundle of folded sheets to bulge by stopping the bundle of folded sheets after the bundle of folded sheets is transported a predetermined conveyance distance downstream in the sheet conveyance direction from a contact position between the contact member and the folded portion of the bundle of folded sheets, and forming a spine of the bundle of folded sheets by squeezing a bulging portion of the bundle of folded sheets created between the sheet conveyer and the contact member in the direction of thickness of the bundle with the folded portion pressed against the contact member. The predetermined distance is set in accordance with a predetermined sheet-related variable.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
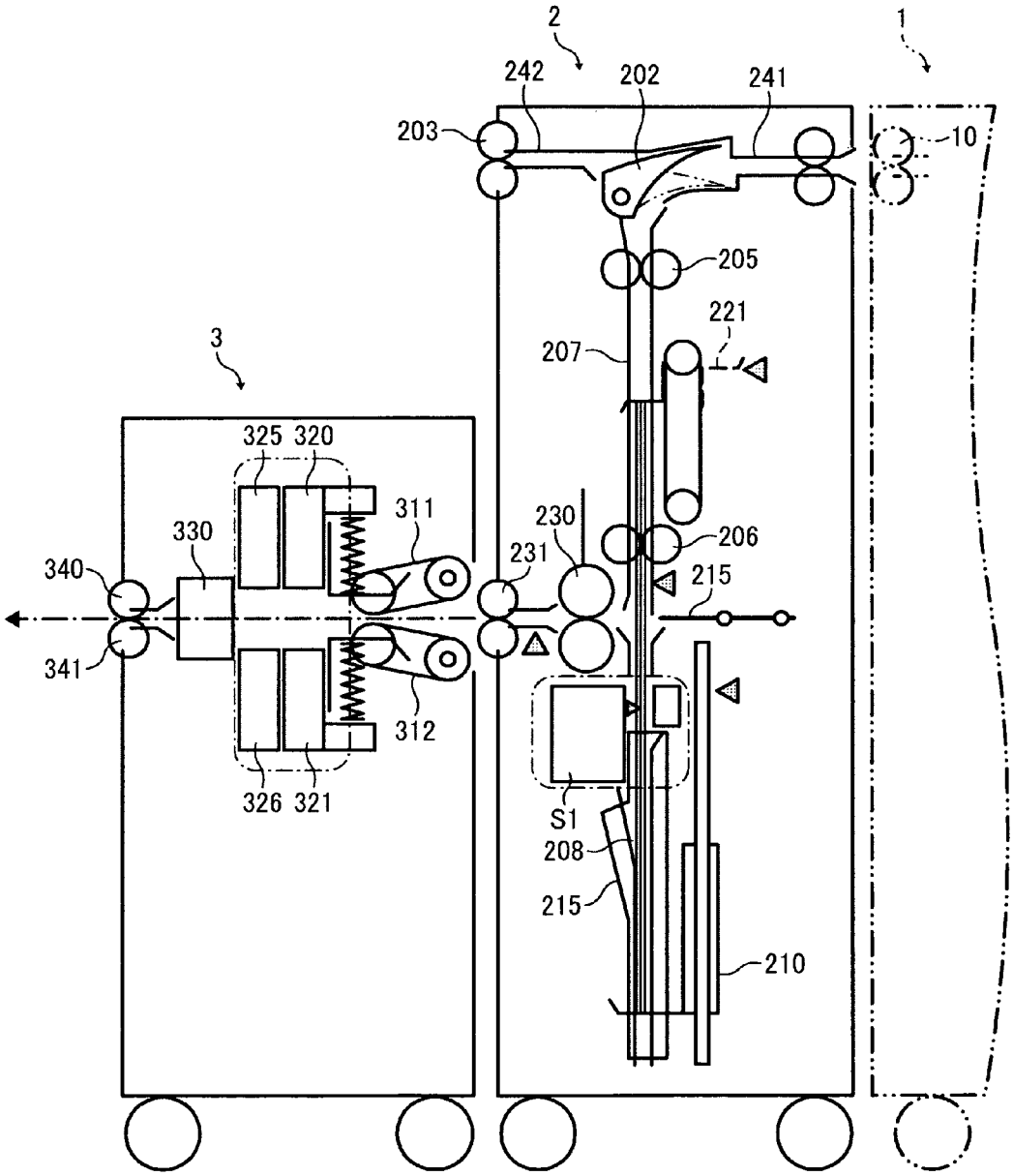
FIG. 1 illustrates a bookbinding system including an image forming apparatus, a post-processing apparatus, and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a bookbinding system according to an illustrative embodiment of the present invention is described.

In the embodiments of the present invention, the spine and the portions on the front side and the back side adjacent to the spine are pressed and flattened so that the front side and the back side are perpendicular or substantially perpendicular to the spine, forming a square spine portion. Flattening the spine of the booklets allows a relatively large number of booklets to be piled together with ease and makes it easier to store or transport them. To shape the spine, a spine formation device according to illustrative embodiments of the present invention includes a conveyance unit, an auxiliary clamping unit, a clamping unit, and a contact member disposed, in that order, in a direction in which a bundle of folded sheets is transported (hereinafter "booklet conveyance direction"). The gap between the pair of guide plates, the counterparts in the auxiliary clamping unit, and the counterparts in the clamping unit is reduced gradually, in that order, that is, from the upstream side in the sheet conveyance direction, thereby localizing the bulging of the booklet to the downstream side. Then, the clamping units squeeze the bundle of sheets while a leading edge of the bundle is pressed against the contact member. Thus, the bundle of sheets is shaped into a lateral U-shape.

At that time, if forming the spine of the booklet is difficult because the quantity of sheets in the booklet is relatively large or the sheets are relatively thick, the amount of the leading edge portion of the booklet pressed against the contact member (hereinafter "pressed amount") is increased. With this adjustment, the folded portion can be squeezed into a spine with sharp corners. Thus, the spine of the bundle of folded sheets can be formed reliably even when the quantity of sheets is relatively large or the sheets are relatively thick.

An illustrative embodiment is described below with reference to FIG. 1.

FIG. 1 illustrates a bookbinding system including a post-processing apparatus 1, a bookbinding device 2, and a spine formation device 3 according to an illustrative embodiment of the present invention.

Figure 19:
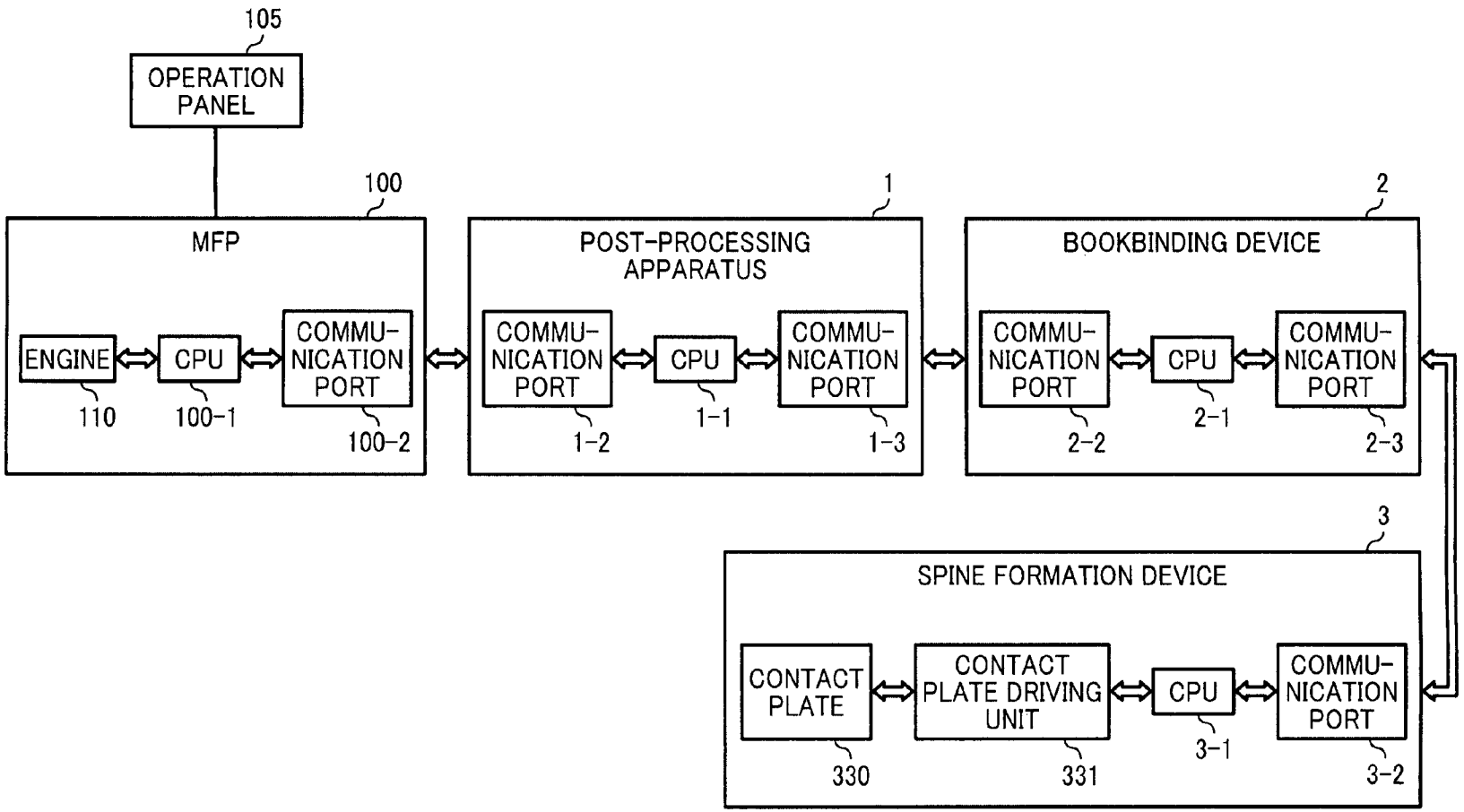
FIG. 19 is a block diagram illustrating a configuration of online control of the bookbinding system.

When connected to an image forming apparatus 100, which is shown as a multifunction peripheral (MFP) 100 in FIG. 19, this system functions as a bookbinding system that can perform image formation through bookbinding inline or online.

In this system, the bookbinding device 2 performs saddle-stitching or saddle-stapling, that is, stitches or staples, along its centerline, a bundle of sheets discharged thereto by a pair of discharge rollers 10 from the post-processing apparatus 1 and then folds the bundle of sheets along the centerline, after which a pair of discharge rollers 231 transports the bundle of folded sheets (booklet) to the spine formation device 3. Then, the spine formation device 3 flattens the folded portion of the booklet and discharges it outside the spine formation device 3. The image forming apparatus (MFP) 100 shown in FIG. 19 may be a copier, a printer, a facsimile machine, or a digital multifunction machine including at least two of those functions that forms images on sheets of recording media based on image data input by users or read by an image reading unit. The MFP 100 includes a printer engine for forming images and a scanner engine for reading images, together forming an engine 110 shown in FIG. 19. The spine formation device 3 includes transport belts 311 and 312, auxiliary clamping plates 320 and 321, clamping plates 325 and 326, a contact plate 330, and a pair of discharge rollers 340 and 341 disposed in that order in the sheet conveyance direction. The auxiliary clamping plates 320 and 321 and the clamping plates 325 and 326 respectively serve as first clamping members and second clamping members, which together form a clamping unit.

Figure 2:
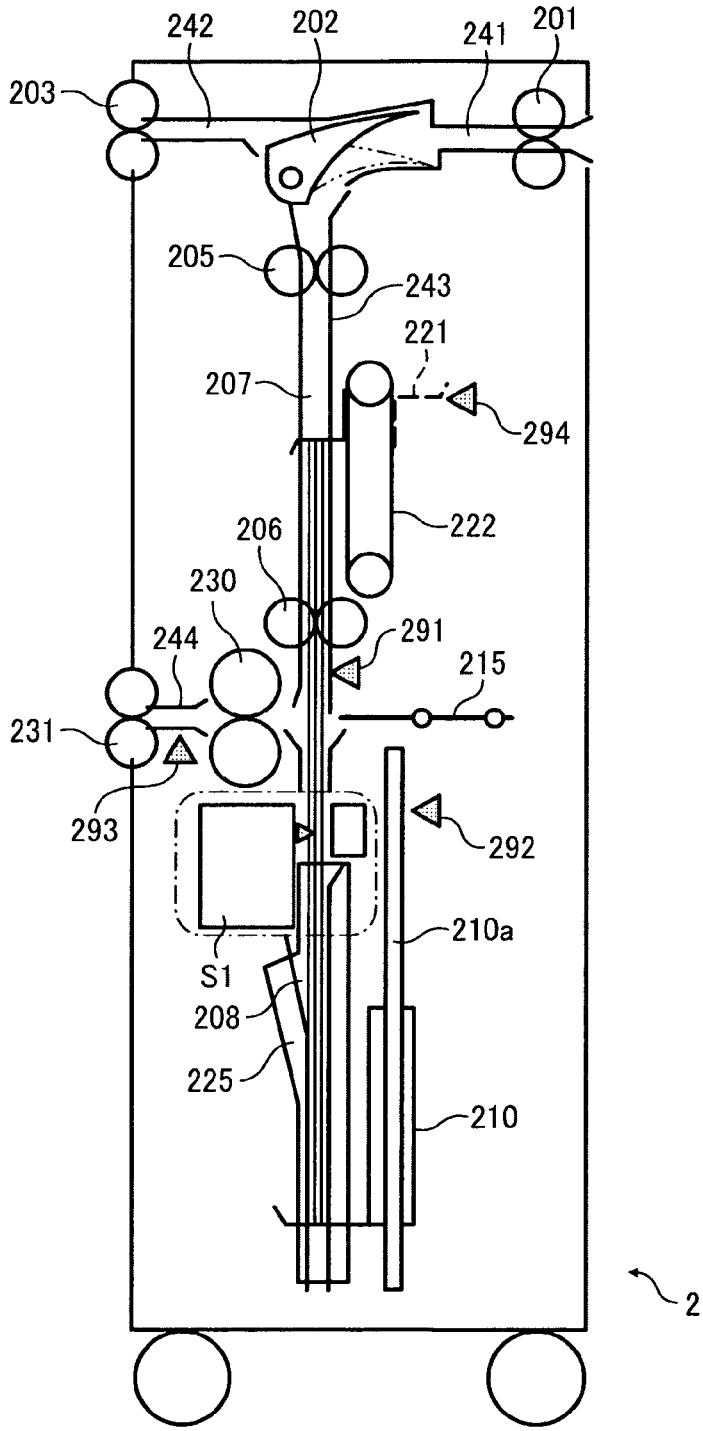
FIG. 2 is a front view illustrating a configuration of the post-processing apparatus shown in FIG. 1.

Referring to FIGS. 1 and 2, a configuration of the bookbinding device 2 is described below.

FIG. 2 illustrates a configuration of the bookbinding device 2.

Referring to FIG. 2, an entrance path 241, a sheet path 242, and a center-folding path 243 are formed in the bookbinding device 2. A pair of entrance rollers 201 provided extreme upstream in the entrance path 241 in the sheet conveyance direction receives a bundle of aligned sheets transported by the discharge rollers 10 of the post-processing apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in FIG. 2 and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in FIGS. 1 and 2 from the separation pawl 202, and the bundle of sheets is transported along the folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 2. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 2, thus aligning the bundle of sheets. Additionally, as indicated by broken lines shown in FIG. 2, the trailing-edge pawl 221 moves away from the upper sheet guide 207 provided along the center-folding path 243 when the bundle of sheets enters the center-folding path 243 and when the bundle of sheets ascends to be folded. In FIG. 2, reference numeral 294 represents a pawl home position (HP) detector that detects the trailing-edge alignment pawl 221 at a home position indicated by the broken lines shown in FIG. 2. The trailing-edge alignment pawl 221 is controlled with reference to the home position.

A saddle stapler S1, a pair of jogger fences 225, and the movable fence 210 are provided along the lower sheet guide 208 in that order from the top in FIG. 2. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the post-processing apparatus 2 in FIG. 2. A movable range of the movable fence 210 that contacts the leading edge of the bundle of sheets is set so that strokes of the movable fence 210 can align sheets of any size processed by the bookbinding device 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the enter-folding path 243 in FIG. 2. The folding plate 215 can move reciprocally back and forth horizontally in FIG. 2 in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 2 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizes the passage of the bundle of folded sheets.

Saddle-stapling and center-holding performed by the bookbinding device 2 shown in FIG. 2 are described briefly below with reference to FIGS. 3 through 7. When a user selects saddle-stapling and center-folding via an operation panel 105 (shown in FIG. 19) of the image forming apparatus 100 (shown in FIG. 19), the separation pawl 202 pivots counterclockwise in FIG. 2, thereby guiding the bundle of sheets to be stapled and folded to the center-folding path 243. The separation pawl 201 is driven by a solenoid, not shown. Alternatively, the separation pawl 201 may be driven by a motor.

Figure 3:
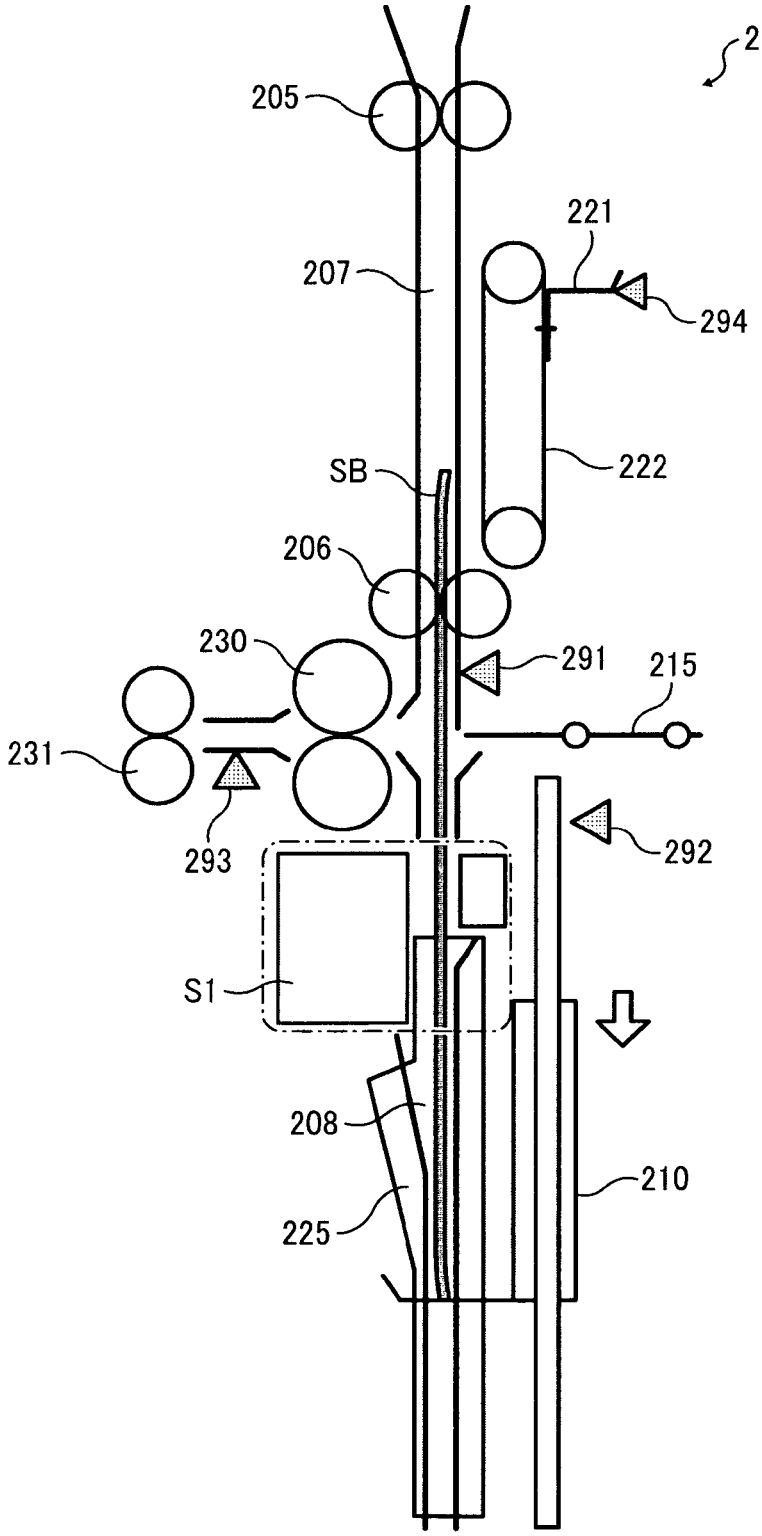
FIG. 3 illustrates the post-processing apparatus in which a bundle of sheets is transported.

A bundle of sheets SB transported to the center-folding path 243 is transported by pair of entrance rollers 201 and the pair of upper transport rollers 205 downward in the center-folding path 243 in FIG. 3. After the sheet detector 291 detects the passage of the bundle of sheets SB, the lower transport rollers 206 transport the bundle of sheets SB until the leading edge of the bundle of sheets SB contacts the movable fence 210 as shown in FIG. 3. At that time, the movable fence 210 is at a standby position varied in the vertical direction shown in FIG. 3 according to size data of the bundle of sheets SB, which in this operation is size data in the sheet conveyance direction, transmitted from the image forming apparatus 100 shown in FIG. 19. Simultaneously, the lower transport rollers 206 clamp the bundle of sheets SB therebetween, and the trailing-edge alignment pawl 221 is at the home position.

Figure 4:
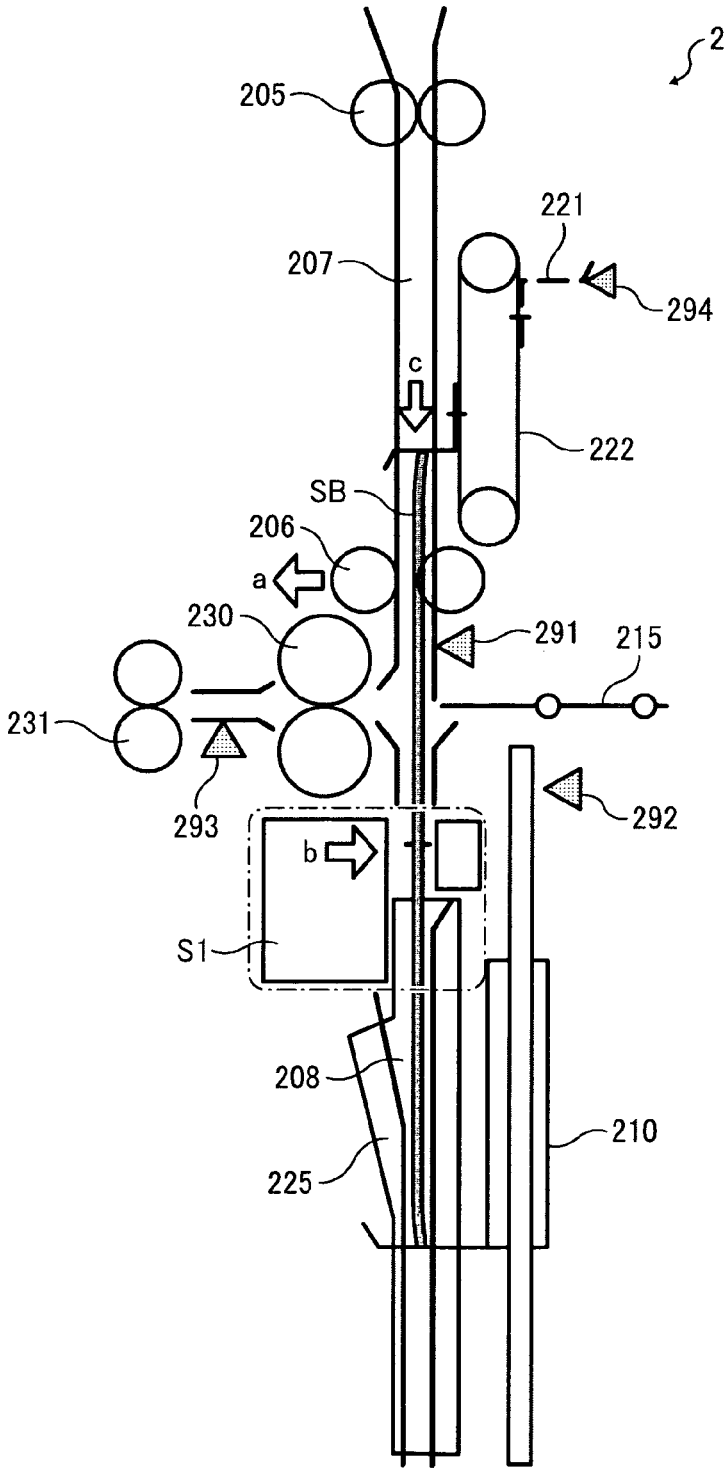
FIG. 4 illustrates the post-processing apparatus in which the bundle of sheets is stapled along the centerline.

When the pair of lower transport rollers 206 is moved away from each other as indicated by arrow a shown in FIG. 4, releasing the trailing edge of the bundle of sheets SB whose leading edge is in contact with the movable fence 210, the trailing-edge alignment pawl 221 is driven to push the trailing edge of the bundle of sheets SB, thus completing alignment of the bundle of sheets SB in the sheet conveyance direction as indicated by arrow c shown in FIG. 4.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the size data (sheet size data) of the bundle of sheets including the quantity of sheets and the thickness of the bundle. It is to be noted that, in addition to the sheet size data including the quantity of sheets and the thickness of the bundle, special sheet classification that indicates that the bundle is formed with special type of sheets is used in setting mode described later.

It is to be noted that, when the bundle of sheets SB is relatively thick, it occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the quantity of sheets increases, it takes longer to stack multiple sheets one on another upstream from the post-processing apparatus 2, and accordingly it takes longer before the post-processing apparatus 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler 51 is driven in a direction indicated by arrow b shown in FIG. 4, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 2-1 (shown in FIG. 19) of the bookbinding device 2.

Figure 5:
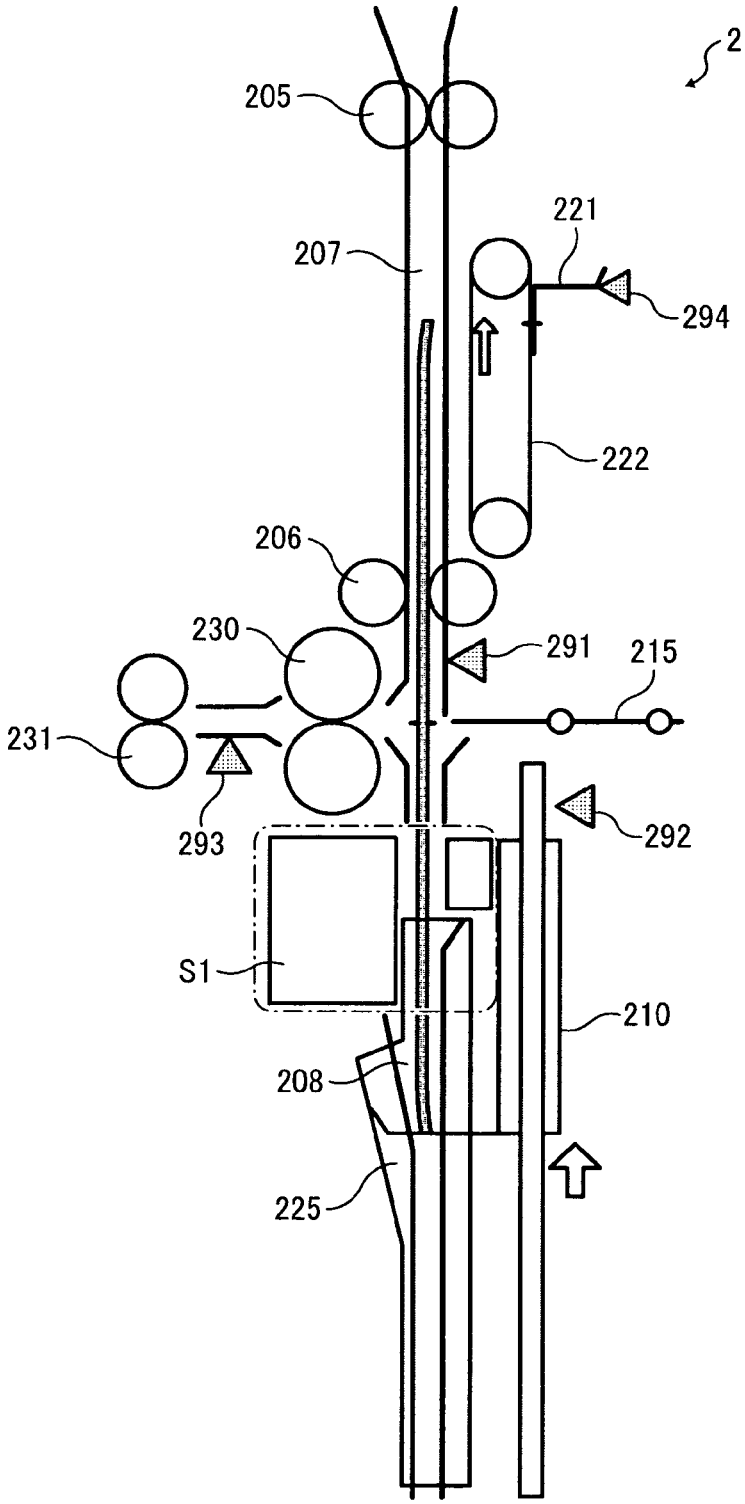
FIG. 5 illustrates the post-processing apparatus in which the bundle of sheets is set at a center-folding position.

After stapled along the centerline in the state shown in FIG. 4, the bundle of sheets SB is lifted to a position where the saddle-stapling position thereof faces the folding plate 215 as the movable fence 210 moves upward as shown in FIG. 5 while the pair of lower transport rollers 206 does not press against the bundle of sheets SB. This position is adjusted with reference to the position detected by the fence HP detector 292.

Figure 6:
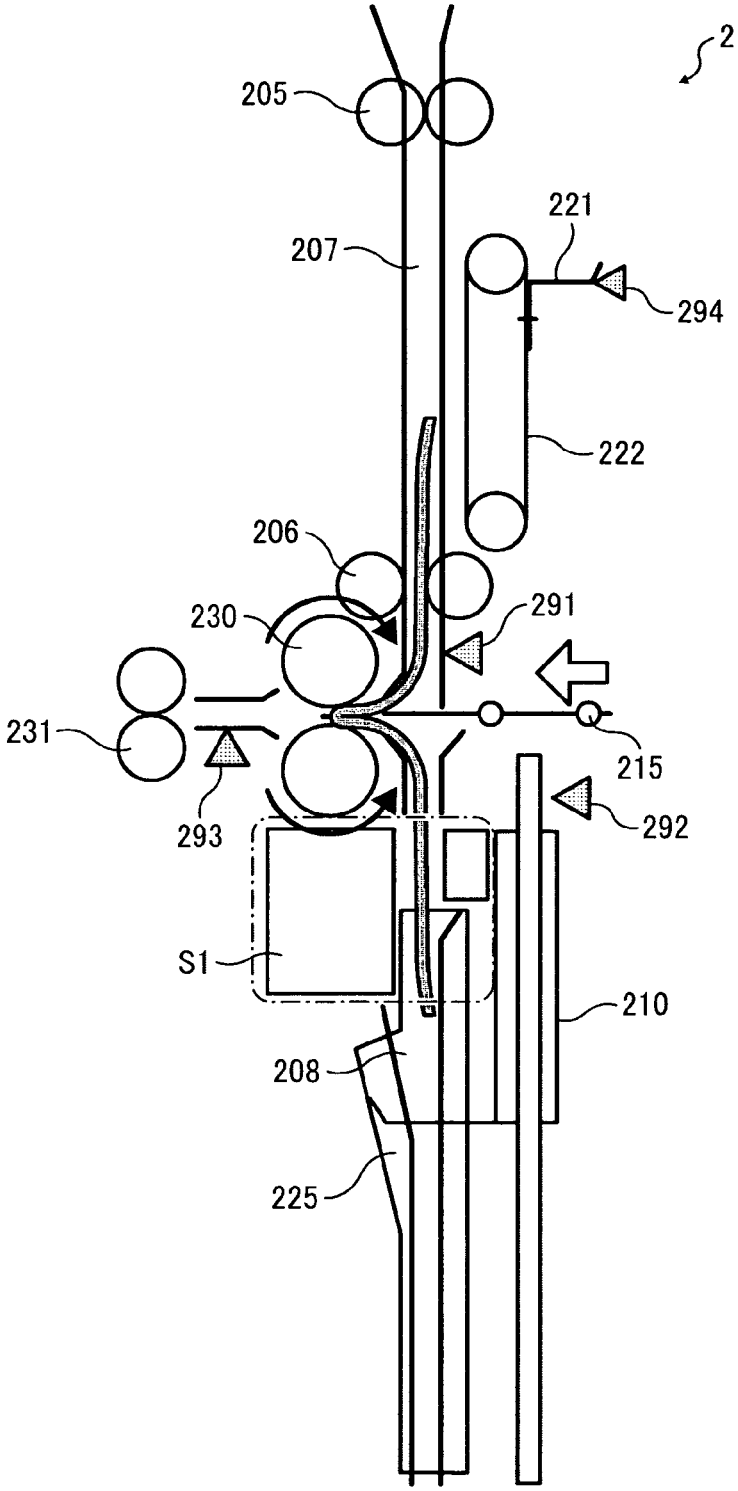
FIG. 6 illustrates the post-processing apparatus in which the bundle of sheets is being folded in two.
Figure 7:
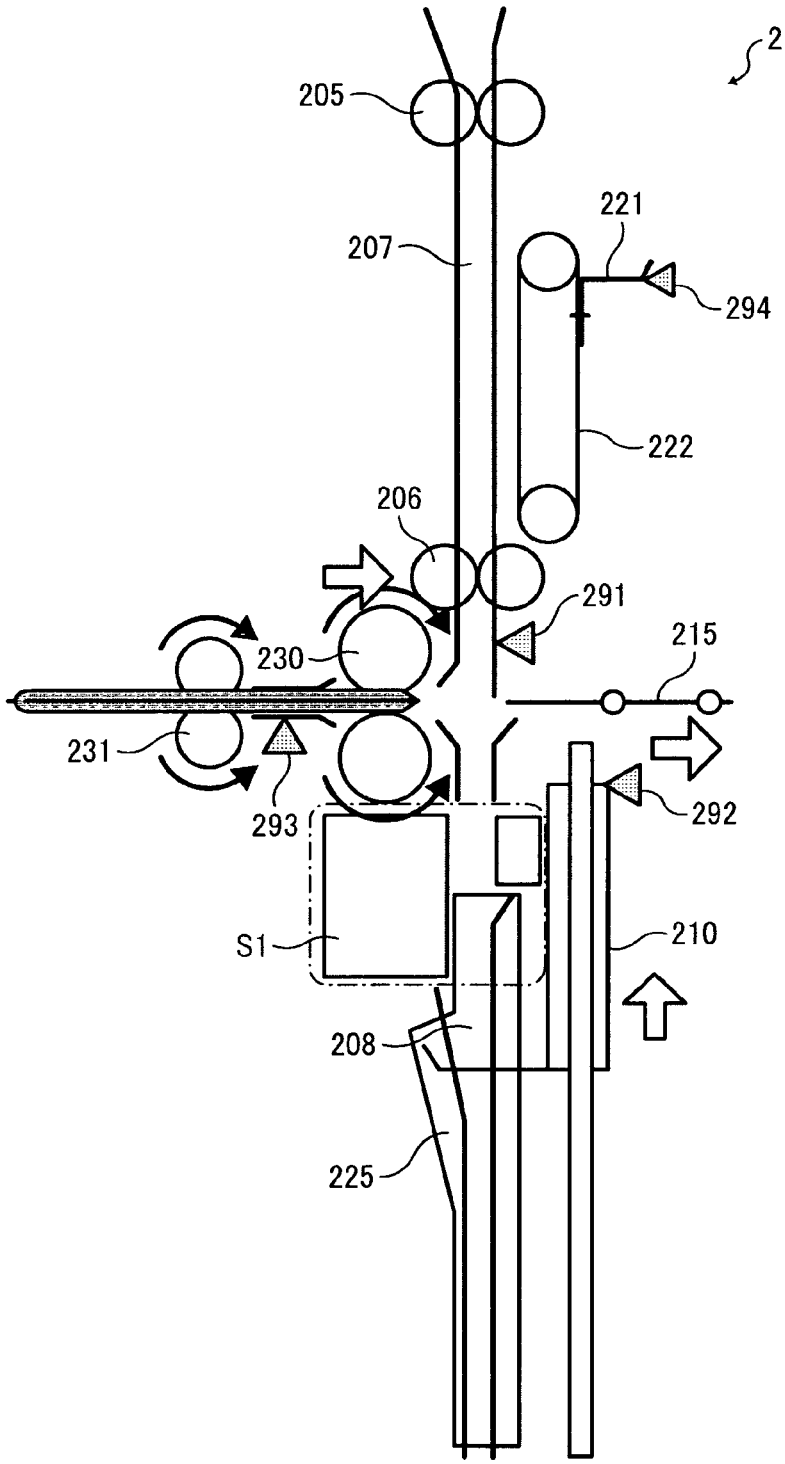
FIG. 7 illustrates the post-processing apparatus from which the bundle of folded sheets is discharged.

When the bundle of sheets SB is set at the position shown in FIG. 5, the folding plate 215 approaches the nip between the pair of folding rollers 230 as shown in FIG. 6 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and clamped between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB. FIG. 6 illustrates a state in which a folded leading edge of the booklet SB is squeezed in the nip between the folding rollers 230.

After folded in two as shown in FIG. 6, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 can wait again at the position shown in FIG. 3. The above-described control is performed also by the CPU 2-1 of a control circuit shown in FIG. 19.

Figure 8:
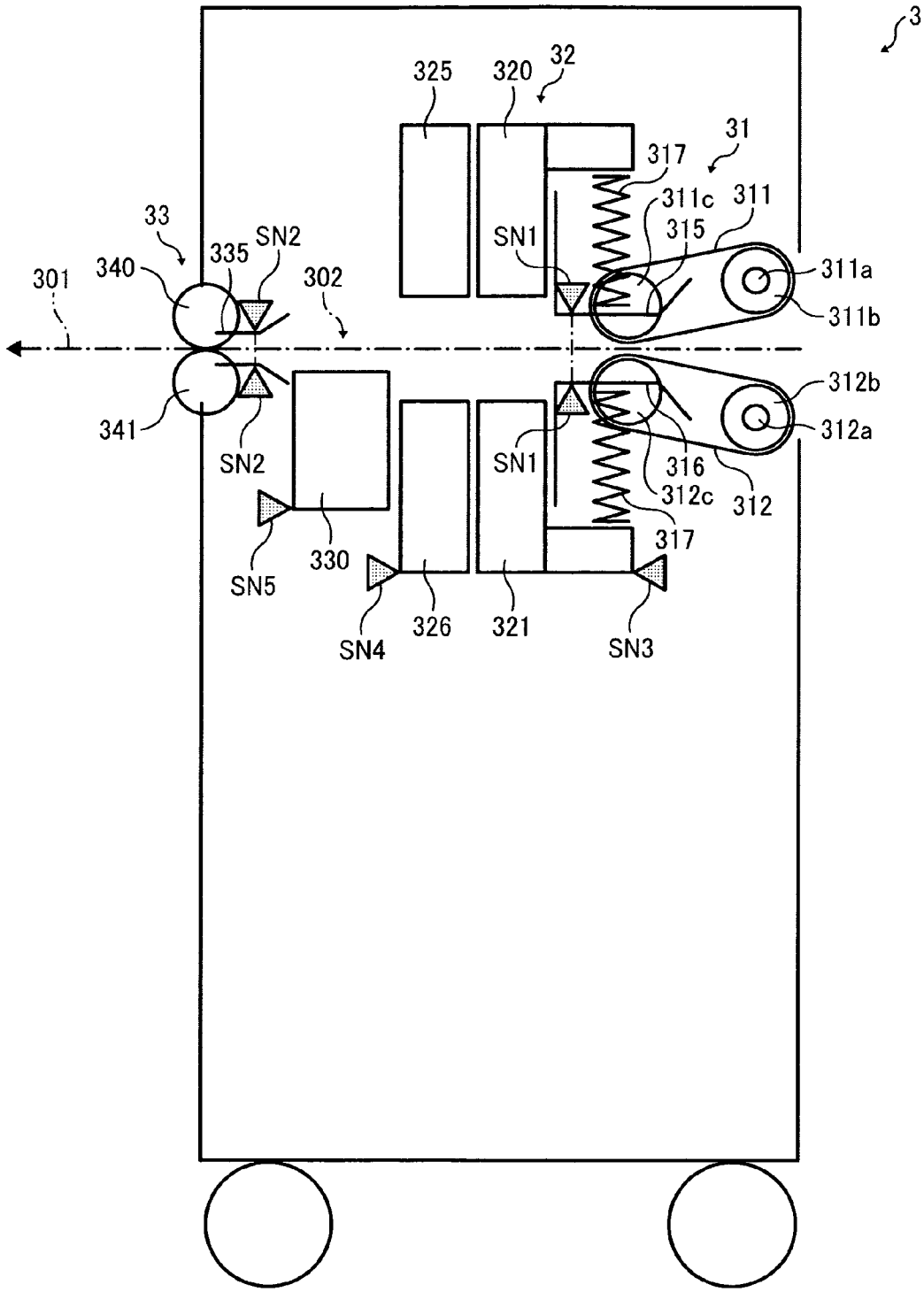
FIG. 8 is a front view illustrating a configuration of the spine formation devices shown in FIG. 1.

FIG. 8 is a front view illustrating a configuration of the spine formation device 3 shown in FIG. 1. Referring to FIG. 8, the spine formation device 3 includes a conveyance unit 31, an auxiliary clamping unit 32, a clamping unit (i.e., clamping plates 325 and 326), a contact member, and a discharge unit 33. It is to be noted that, in this specification, the booklet means the bundle of sheets that is folded and stapled along its centerline and is different from unbound sheets S.

The conveyance unit 31 includes the vertically-arranged transport belts 311 and 312, and the auxiliary clamping unit 32 includes vertically-arranged guide plates 315 and 316 and the auxiliary clamping plates 320 and 321. The contact plate 330 serves as the contact member, and the discharge unit 33 includes the discharge guide plate 335 and the pair of discharge rollers 340 and 341. It is to be noted that, the lengths of the above-described components are greater than the width of the booklet SB in a direction perpendicular to the surface of paper on which FIG. 8 is drawn. The auxiliary clamping unit 32, the clamping plates 325 and 326, and the contact plate 330 together form a spine formation unit.

Figure 9A:
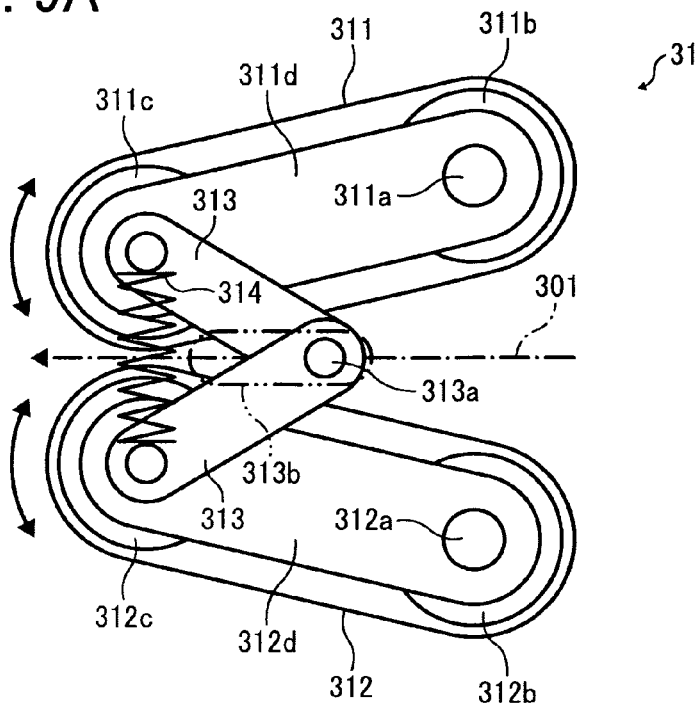
FIG. 9A illustrates an initial state of a transport unit of the spine formation device shown in FIG. 8 to transport a bundle of folded sheets.
Figure 9B:
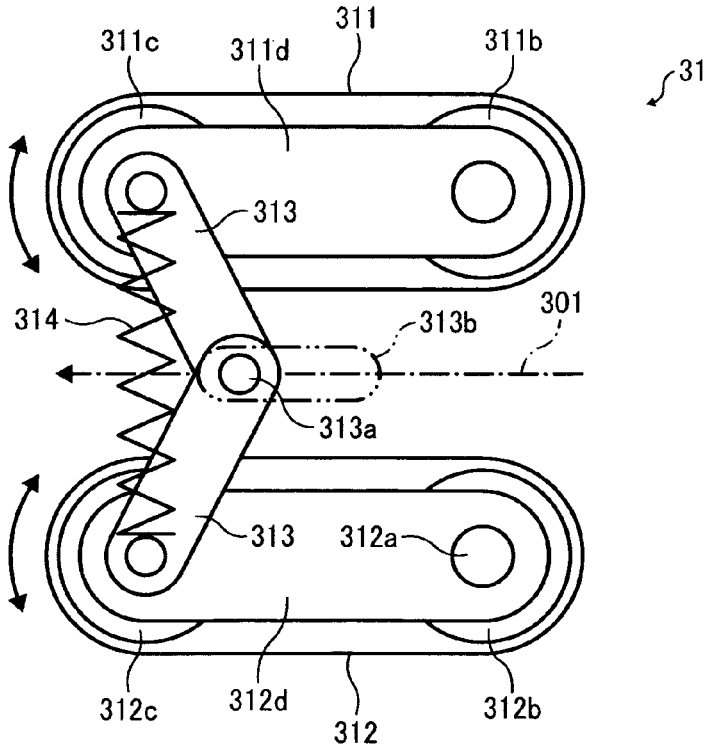
FIG. 9B illustrates a state of the transport unit shown in FIG. 9A in which the bundle of folded sheets is transported.

The transport belts 311 and 312 are disposed on both sides of (in FIG. 8, above and beneath) a transport centerline 301 of a transport path 302, aligned with the line extended from the line connecting the folding plate 215, the nip between the folding rollers 230, and the nip between the discharge rollers 231. The upper transport belt 311 and the lower transport belt 312 are respectively stretched around driving pulleys 311*b* and 312*b* supported by swing shafts 311*a* and 312*a* and driven pulleys 311*c* and 312*c* that are disposed downstream from the driving pulleys 311*b* and 312*b* and face each other across the transport centerline 301. A driving motor, not shown, drives the transport belts 311 and 312. The swing shafts 311*a* and 312*a* respectively support the transport belts 311 and 312 swingably so that the gap between the driven pulleys 311*c* and 312*c* is adjusted corresponding to the thickness of the bundle of sheets. FIGS. 9A and 9B illustrate an initial state of the spine formation device 3 and a state in which the booklet SB is transported therein, respectively.

As shown in FIGS. 9A and 9B, the driving pulleys 311*b* and 312*b* are connected to the driven pulleys 311*c* and 312*c* with support plates 311*d* and 312*d*, respectively, and the transport belts 311 and 312 are respectively stretched around the driving pulleys 311*b* and 312*b* and the driven pulleys 311*c* and 312*c*. With this configuration, the transport belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b*, thus changing the distance between the driven pulleys 311*c* and 312*c* corresponding to the thickness of the booklet SB while maintaining a predetermined or given pressure in a nip where the transport belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SB is relatively thick, the distance between the driven pulleys 311*c* and 312*c* (hereinafter "transport gap E can be increased to receive the booklet SB, thus reducing the pressure applied to the folded portion (folded leading-edge portion) of the booklet SB by the transport belts 311 and 312 on the side of the driven pulleys 311*c* and 312*c*. It is to be noted that, when power supply to the driving motor is stopped after the folded portion of the booklet SB is clamped between the transport belts 311 and 312, the driven pulleys 311*c* and 312*c* can transport the booklet SB clamped therebetween with only the elastic bias force of the pressure spring 314.

Figure 10A:
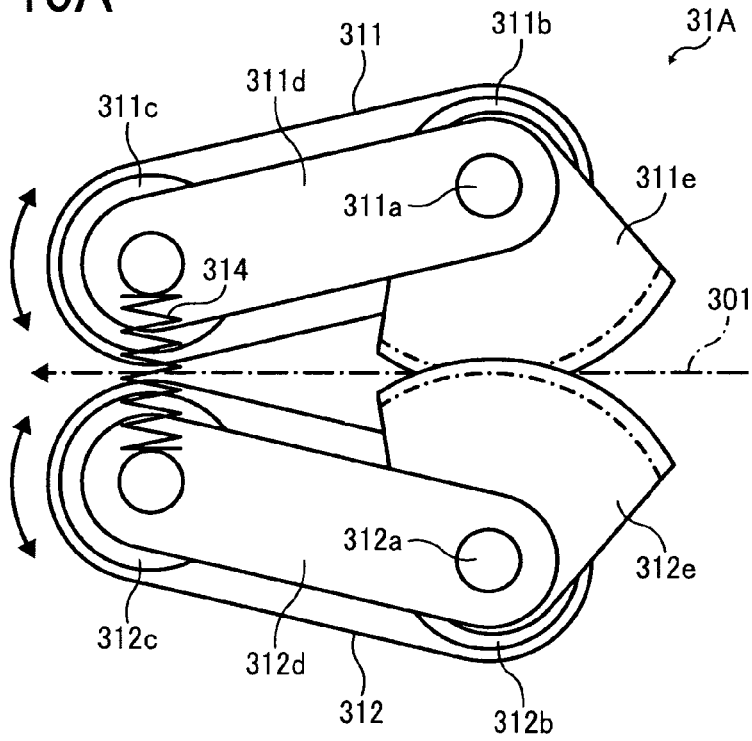
FIGS. 10A and 10B are diagrams of another configuration of the transport unit illustrating an initial state and a state in which the bundle of folded sheets is transported, respectively.
Figure 10B:
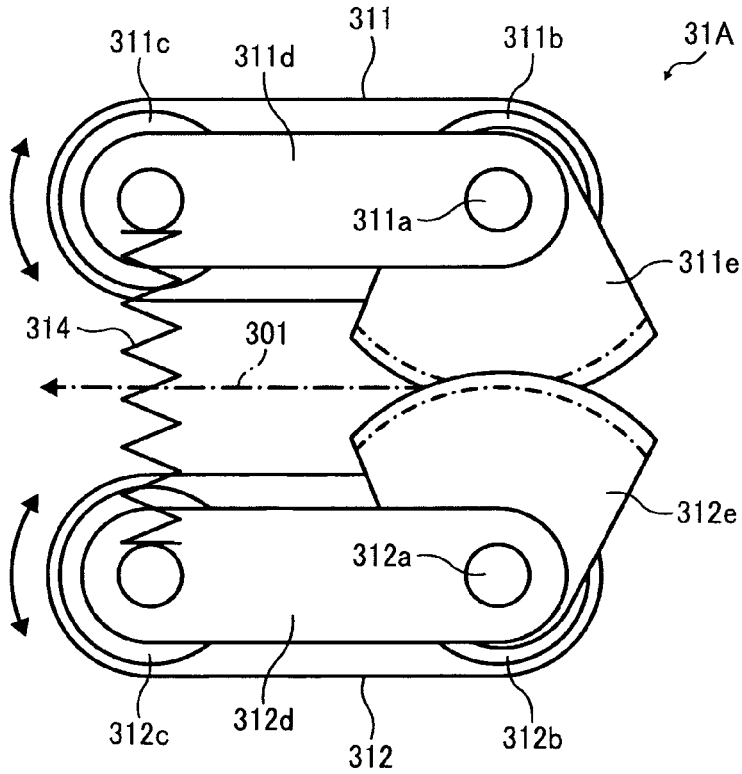

FIGS. 10A and 10B illustrate a conveyance unit 31A in which, instead of using the link 314, the swing shafts 311*a* and 312*a* engage sector gears 311*e* and 312*e*, respectively, and the sector gears 311*e* and 312*e* engaging each other cause the driven pulleys 311*c* and 312*c* to move away from the transport centerline 301 symmetrically. FIGS. 10A and 10B illustrate an initial state of the conveyance unit 31A and a state in which the booklet SB is transported therein, respectively. Also in this configuration, the size of the transport gap to receive the booklet SB can be adjusted by driving one of the sector gears 311*e* and 312*e* with a driving motor including a decelerator similarly to the configuration shown in FIGS. 9A and 9B.

As shown in FIG. 8, the guide plates 315 and 316 are arranged symmetrically on both sides of the transport centerline 301, adjacent to the driven pulleys 311*c* and 312*c*, respectively. The guide plates 315 and 316 respectively include flat surfaces facing the transport path 302, extending from the transport nip to a position adjacent to the auxiliary clamping plates 320 and 321, and the flat surfaces serve as transport surfaces. The upper guide plate 315 and the lower guide plate 316 are attached to the upper auxiliary clamping plate 320 and the lower auxiliary clamping plate 321 with pressure springs 317, respectively, biased to the transport centerline 301 elastically by the respective pressure springs 317, and can move vertically. Further, the auxiliary clamping plates 320 and 321 are held by a housing of the spine formation device 3 movably in the vertical direction in FIG. 8. It is to be noted that, alternatively, the guide plates 315 and 316 may be omitted, and the booklet SB may be guided by only surfaces of the auxiliary clamping plates 320 and 321 facing the booklet SB.

The vertically-arranged auxiliary clamping plates 320 and 321 of the auxiliary clamping unit 32 approach and move away from each other symmetrically relative to the transport centerline 301 similarly to the transport belts 311 and 312. A driving mechanism, not shown, provided in the auxiliary clamping unit 32 to cause this movement can use the link mechanism used in the conveyance unit 31 or the connection mechanism using the rack and the sector gear shown FIGS. 10A and 10B.

A reference position used in detecting a displacement of the auxiliary clamping plates 320 and 321 can be set with the output from the auxiliary clamping plate HP detector SN3. Because the vertically-arranged auxiliary clamping plates 320 and 321 and the driving unit, not shown, are connected with a spring similar to the pressure spring 314 in the conveyance unit 31, or the like, when the booklet SB is clamped by the auxiliary clamping plates 320 and 321, damage to the driving mechanism caused by overload can be prevented. The surfaces of the auxiliary clamping plates 320 and 321 (e.g., pressure clamping surfaces) that clamp the booklet SB are flat surfaces in parallel to the transport centerline 301.

The vertically-arranged clamping plates 325 and 326, serving as the first clamping members, approach and move away from each other symmetrically with respect to the transport centerline 301 similarly to the transport belts 311 and 312. A driving mechanism to cause the clamping plates 325 and 326 this movement can use the link mechanism used in the conveyance unit 31 or the connection mechanism using the rack and the sector gear shown FIGS. 10A and 10B. A reference position used in detecting a displacement of the clamping plates 325 and 326 can be set with the output from the clamping plate HP detector SN4. Other than the description above, the clamping plates 325 and 326 have configurations similar the auxiliary clamping plates 320 and 321 and operate similarly thereto, and thus descriptions thereof are omitted. It is to be noted that a driving source such as a driving motor is requisite in the auxiliary clamping unit 32 and the clamping unit although it is not requisite in the conveyance unit 31, and the driving source enables the movement between a position to clamp the booklet and a standby position away form the booklet. The surfaces of the auxiliary clamping plates 325 and 326 (e.g., pressure clamping surfaces) that clamp the booklet are flat surfaces in parallel to the transport centerline 301 similarly to the auxiliary clamping plates 320 and 321.

The contact plate 330 is disposed downstream from the clamping plates 325 and 326. The contact plate 330 and a mechanism, not shown, to move the contact plate 330 vertically in FIG. 8 together form a contact unit. The contact plate 330 moves vertically in FIG. 8 to obstruct the transport path 302 and away from the transport path 302, and a reference position used in detecting a displacement of the contact plate 330 can be set with the output from the contact plate HP detector SN5. When the contact plate 330 is away from the transport path 302, a top surface of the contact plate 330 serves as a transport guide for the booklet SB. Therefore, the top surface of the contact plate 330 is flat, in parallel to the sheet conveyance direction, that is, the transport centerline 301. For example, although not shown in the drawings, the mechanism to move the contact plate 330 can include rack-and-pinions provided on both sides of the contact plate 330, that is, a front side and a back side of the spine formation device 3, and a driving motor to drive the pinions. With this configuration, the contact plate 330 can be moved vertically and set at a predetermined position by driving the driving motor.

It is to be noted that, alternatively, screw driving may be used to move the guide plates 315 and 316, the auxiliary clamping plates 320 and 321, the clamping plates 325 and 326, and the contact plate 330.

Figure 18:
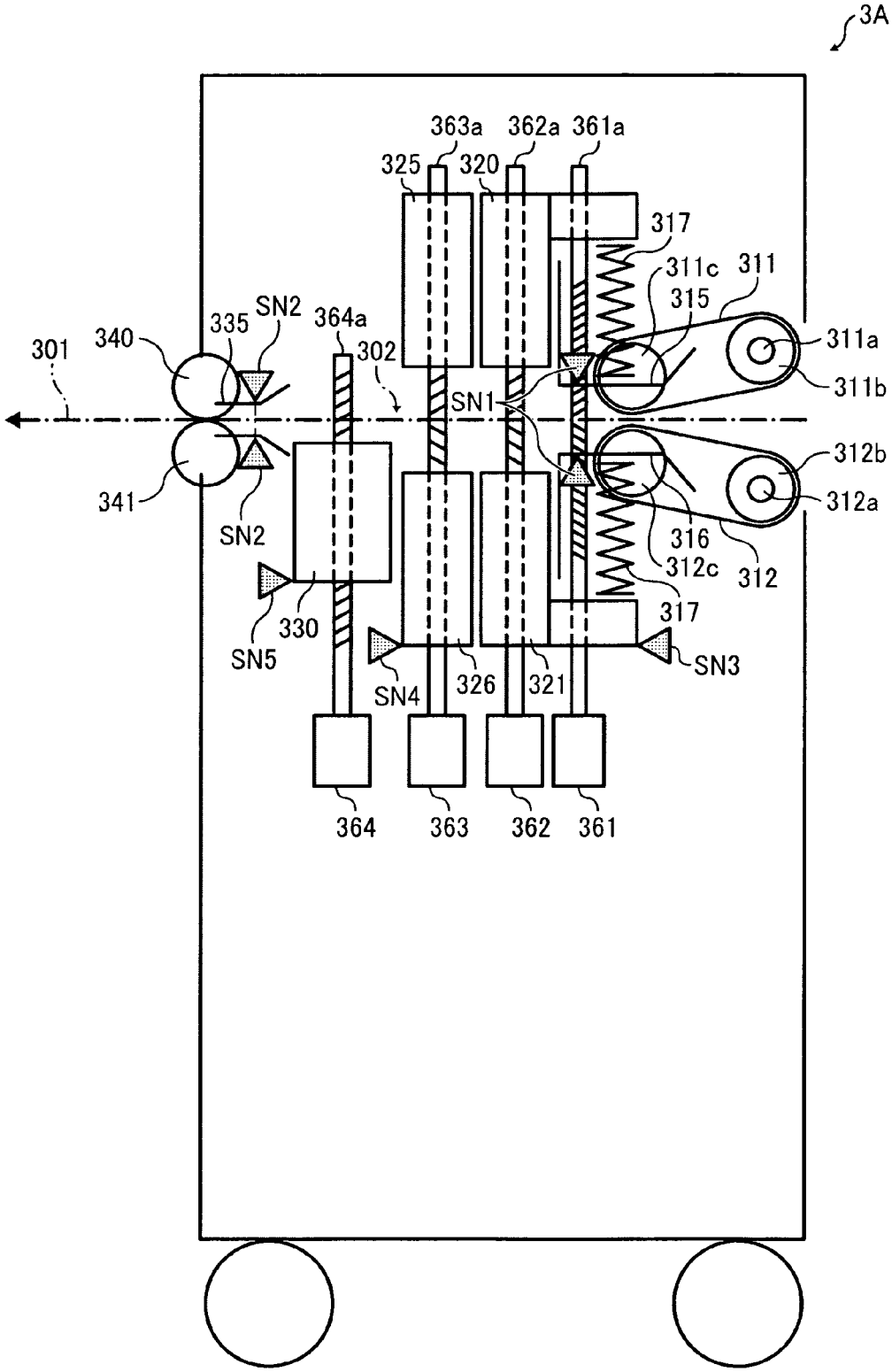
FIG. 18 illustrates a configuration of a spine formation device according to an illustrative embodiment that uses a screw driving to move a pair of guide plates, the pair of auxiliary clamping plates, the pair of clamping plates, and the contact plate.

FIG. 18 illustrates a configuration of a spine formation device 3A that includes driving motors 361, 362, 363, and 364 and screw shafts 361*a*, 362*a*, 363*a*, and 364*a* coaxially with driving shafts of the driving motors 361 through 364, respectively, as the driving mechanism to drive the respective portions.

The motors 361 through 364 respectively include decelerators. The screw shafts 361*a*, 362*a*, and 363*a* to drive the guide plates 315 and 316, the auxiliary clamping plates 320 and 321, and the clamping plates 325 and 326 each have a screw thread winding in opposite directions from a center portion (in FIG. 18, the transport centerline 301). In FIG. 18, the upper auxiliary clamping plate 320 and the lower auxiliary clamping plate 321 are respectively attached to the upper portions and the lower portions of the screw shafts 361*a* and 362*a* having the screw threads winding in the opposite directions. Similarly, the upper clamping plate 325 and the lower clamping plate 326 are respectively attached to the upper portion and the lower portion of the screw shaft 363*a* having the screw thread winding in the opposite directions. With this configuration, the pair of the auxiliary clamping plates 320 and 321 and the pair of clamping plates 325 and 326 can move symmetrically in the direction to approach and the direction away from each other depending on the rotation direction of the driving motors 361, 362, and 363. The axis of symmetry thereof is the transport centerline 301. The driving motor 364 and the screw shaft 364*a* coaxially therewith move the contact plate 330 vertically in FIG. 18.

The screw shafts 361*a*, 362*a*, 363*a*, and 364*a* are disposed on the back side of the spine formation device 3A, outside the sheet area in which the booklet passes through, and a guide rod, not shown, is provided on the front side outside the sheet area. With this configuration, the pair of guide plates 315 and 316, the pair of the auxiliary clamping plates 320 and 321, the pair of clamping plates 325 and 326, and the contact plate 330 can move vertically in parallel to the respective screw shafts 361*a*, 362*a*, 363*a*, and 364*a* engaged therewith as well as the respective guide rods.

Referring to FIG. 8, the discharge unit 33 is disposed downstream from the contact plate 330. The discharge unit 33 includes the pair of discharge guide plates 335 and the pair of discharge rollers 340 and 341 to discharge the booklet SB outside the spine formation device 3 after spine formation. The discharge unit 33 includes a roller disengagement mechanism, described later, to disengage the discharge rollers 340 and 341 from each other. The discharge rollers 340 and 341 are disengaged from each other when the flattened spine of the booklet passes between them, after which the discharge rollers 340 and 341 press against the booklet and discharge the booklet outside the spine formation device 3.

The transport detector SN1 detects the folded portion of the booklet SB. The position of the booklet SB during spine formation and the timing at which the discharge rollers 340 and 341 approach and move away from each other are set by adjusting the distance by which the booklet SB is transported from the position detected by the transport detector SN1.

More specifically, the distance by which the booklet SB is transported from the position detected by the sheet detector SN1 to the position at which the booklet SB is kept during spine formation is a sum of a first distance by which the booklet SB is moved from the detected position to the contact position between the folded portion and the contact plate 330 and a second distance (hereinafter also "predetermined conveyance distance for spine formation") from the contact position. The second distance can be predetermined in accordance with the amount of bulging, that is, the portion expanded in the thickness direction, necessary to shape the folded portion into the spine. This conveyance distance can be adjusted through pulse control, control using an encoder, or the like. Additionally, the discharge detector SN2 is provided upstream from the lower discharge roller 341, adjacent thereto, and detects the passage of the booklet SB in the transport path 302.

FIGS. 11 through 17 illustrate spine formation performed by the spine formation device 3 to flatten the spine of the booklet SB as well as the front cover side and the bock cover side thereof.

Referring to FIGS. 11 through 17, operations performed by the spine formation device 3 to flatten the folded portion, that is, the spine, of the booklet SB are described in further detail below.

Figure 11:
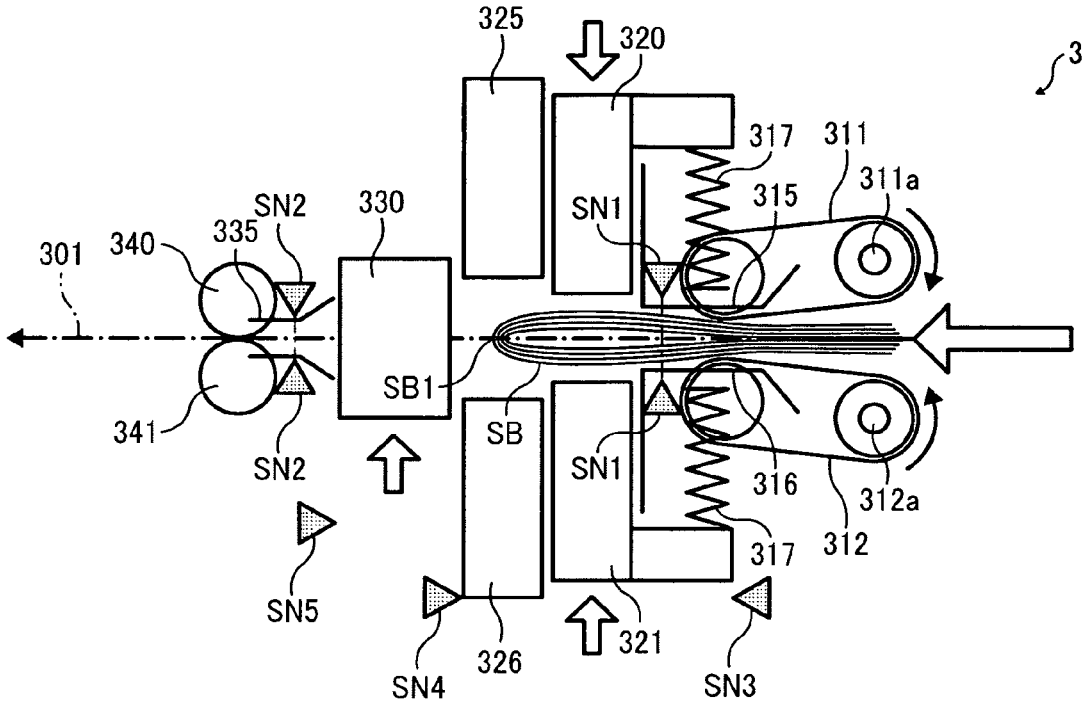
FIG. 11 illustrates a state of the spine formation device in which the bundle of folded sheets is transported therein.

Referring to FIG. 11, according to a detection signal of the booklet SB generated by an entrance sensor, not shown, of the spine formation device 3 or the folded portion detector 293 (shown in FIG. 7) of the bookbinding device 2, the respective portions of the spine formation device 3 perform preparatory operations to receive the booklet SB. In the preparatory operations, the pair of transport belts 311 and 312 starts rotating. Additionally, the upper auxiliary clamping plate 320 and the lower auxiliary clamping plate 321 move to the respective home positions detected by the auxiliary clamping plate HP detector SN3, move toward the transport centerline 301 until the distance (hereinafter "transport gap E") therebetween becomes a predetermined distance, and then stop at those positions. Similarly, the upper clamping plate 325 and the lower clamping plate 326 move to the respective home positions detected by the clamping plate HP detector SN4, move toward the transport centerline 301 until the distance (hereinafter "transport gap") therebetween becomes a predetermined distance, and then stop at those positions. It is to be noted that, because the pair of auxiliary clamping plates 320 and 321 as well as the pair of clamping plates 325 and 326 are disposed and move symmetrically relative to the transport centerline 301, when only one of the counterparts in the pair is detected at the home position, it is known that the other is at the home position as well. Therefore, the auxiliary clamping plate HP detector SN3 and the clamping plate HP detector SN4 are disposed on only one side of the transport centerline 301. The contact plate 330 moves to the home position detected by the contact plate HP detector SN5, moves toward the transport centerline 301 a predetermined distance, and then stops at a position obstructing the transport path 302. This state before the booklet SB enters the spine formation device 3 is shown in FIG. 11.

Figure 12:
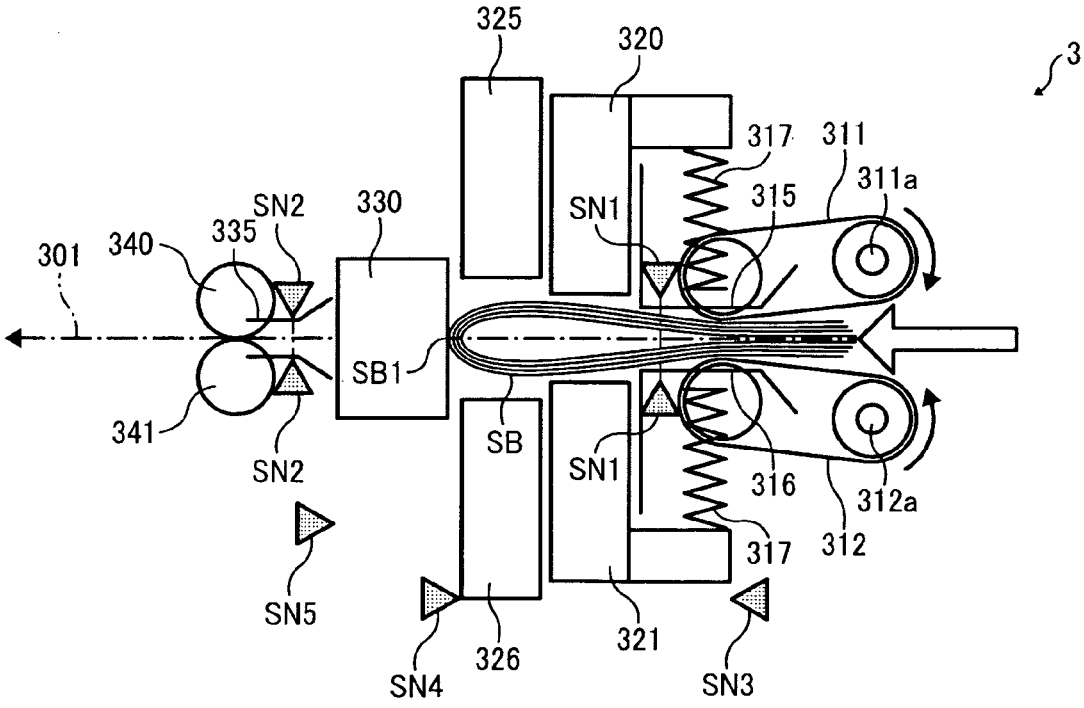
FIG. 12 illustrates a process of spine formation performed by the spine formation device in which the leading edge of the bundle of folded sheets is in contact with a contact plate.

In this state, when the booklet SB is forwarded by the discharge rollers 231 of the bookbinding device 2 to the spine formation device 3, the rotating transport belts 311 and 312 transport the booklet SB inside the device as shown in FIG. 11. The transport detector SN1 detects the folded portion SB1 of the booklet SB. The booklet SB is transported by the transport belts 311 and 312 the predetermined distance that is the sum of the distance until the folded portion SB1 contacts the contact plate 330 (first distance) and the distance necessary to form the spine (conveyance distance for spine formation") by expanding the folded portion SB1 in the thickness direction, after which the booklet SB is kept at that position as shown in FIG. 12. The predetermined conveyance distance for spine formation is set corresponding to the sheet-related data of the booklet SB such as the sheet thickness, the sheet size, the quantity of sheets, and the special sheet classification of the booklet SB.

Figure 13:
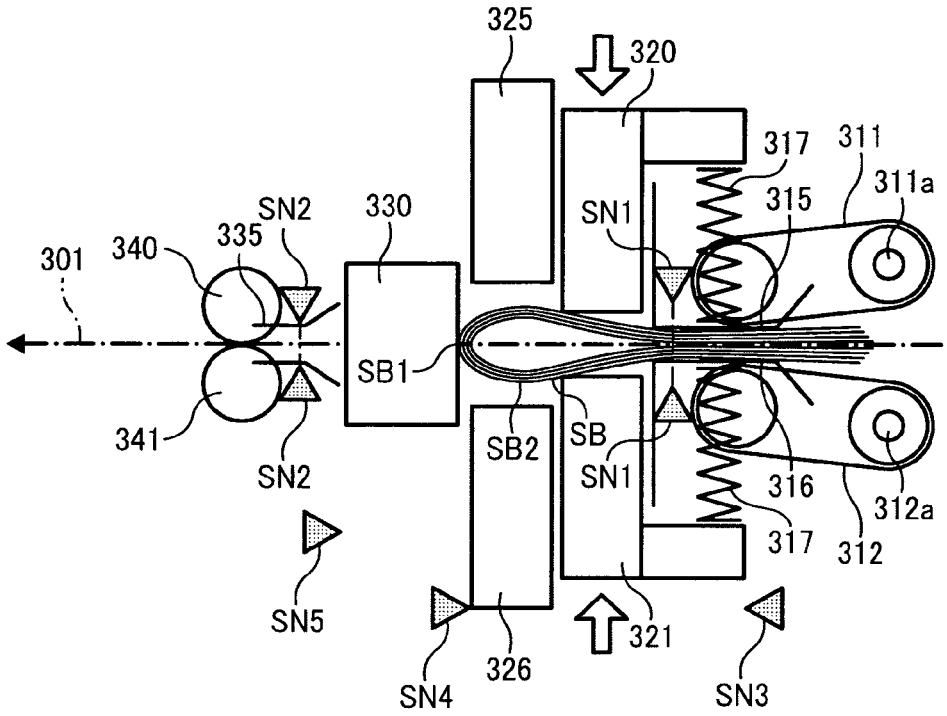
FIG. 13 illustrates a process of spine formation performed by the spine formation device, in which a pair of auxiliary clamping plates approaches the bundle of folded sheets to clamp it therein.
Figure 14:
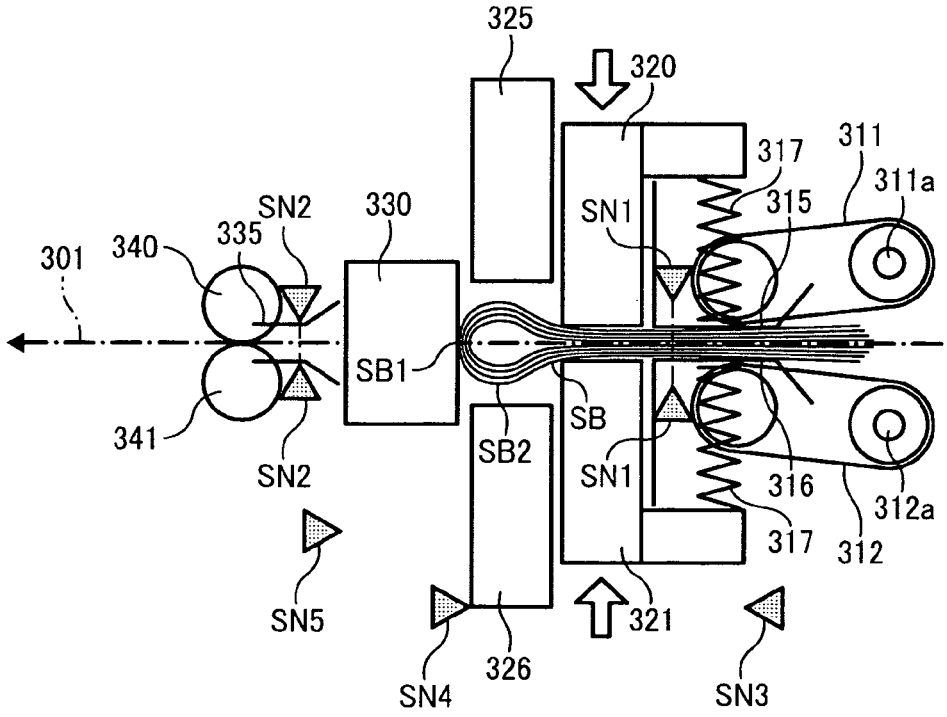
FIG. 14 illustrates a process of spine formation performed by the spine formation device in which the pair of auxiliary clamping plates squeezes the bundle of folded sheets.

When the booklet SB is stopped in the state shown in FIG. 12, referring to FIG. 13, the auxiliary clamping plates 320 and 321 start approaching the transport centerline 301, and the pair of guide plates 315 and 316 presses against the booklet SB clamped therein with the elastic force of the pressure springs 317 initially. After the pair of guide plates 315 and 316 start applying a predetermined pressure to the booklet SB, the auxiliary clamping plates 320 and 321 further approach the transport centerline 301 to squeeze the booklet SB in the portion downstream from the portion clamped by the guide plates 315 and 316 and then stop moving when the pressure to the booklet SB reaches a predetermine or given pressure, with the booklet SB held with the predetermined pressure as shown in FIG. 14. With the folded leading-edge portion SB1 of the booklet SB pressed against the contact plate 330, the bulging portion SB2 upstream from the folded leading-edge portion SB1 is larger than that shown in FIG. 13.

Figure 15:
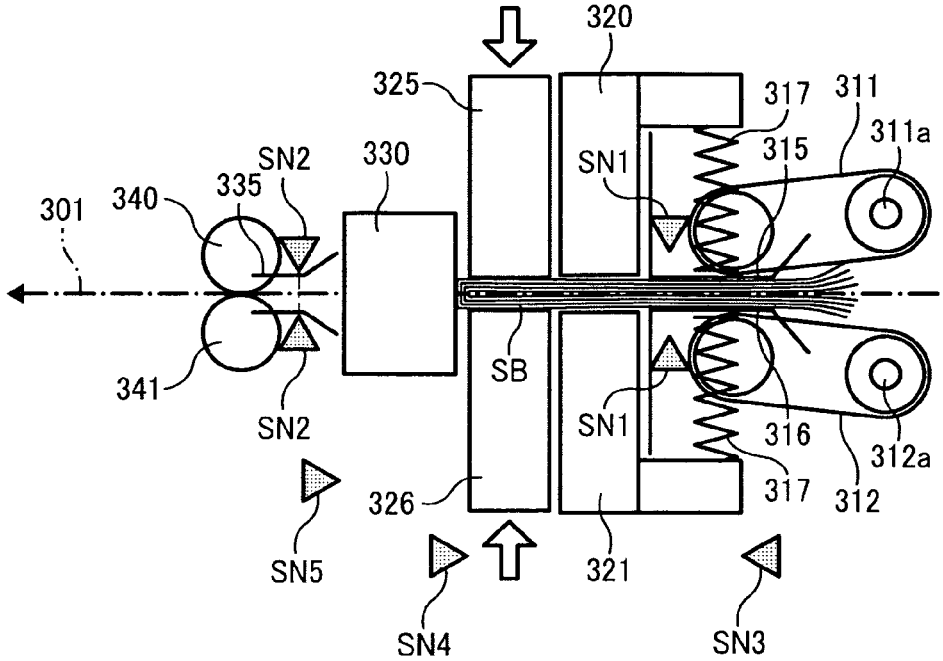
FIG. 15 illustrates a process of spine formation performed by the spine formation device in which a pair of clamping plates squeezes the bundle of folded sheets.

After the auxiliary clamping plates 320 and 321 squeeze the booklet SB as shown in FIG. 14, the clamping plates 325 and 326 start approaching the transport centerline 301 as shown in FIG. 15. With this movement, the bulging portion SB2 is localized to the side of the folded leading-edge portion SB1, pressed gradually, and then deforms following the shape of the space defined by the pair of clamping plates 325 and 326 and the contact plate 330. After this compressing operation is completed, the folded portion SB1 of the booklet SB is flat following the surface of the contact plate 330, and thus the flat spine is formed on the booklet SB. In addition, leading end portions SB3 and SB4 on the front side (front cover) and the back side (back cover) are flattened as well. Thus, as shown in FIG. 17, booklets having square spines can be produced.

Figure 16:
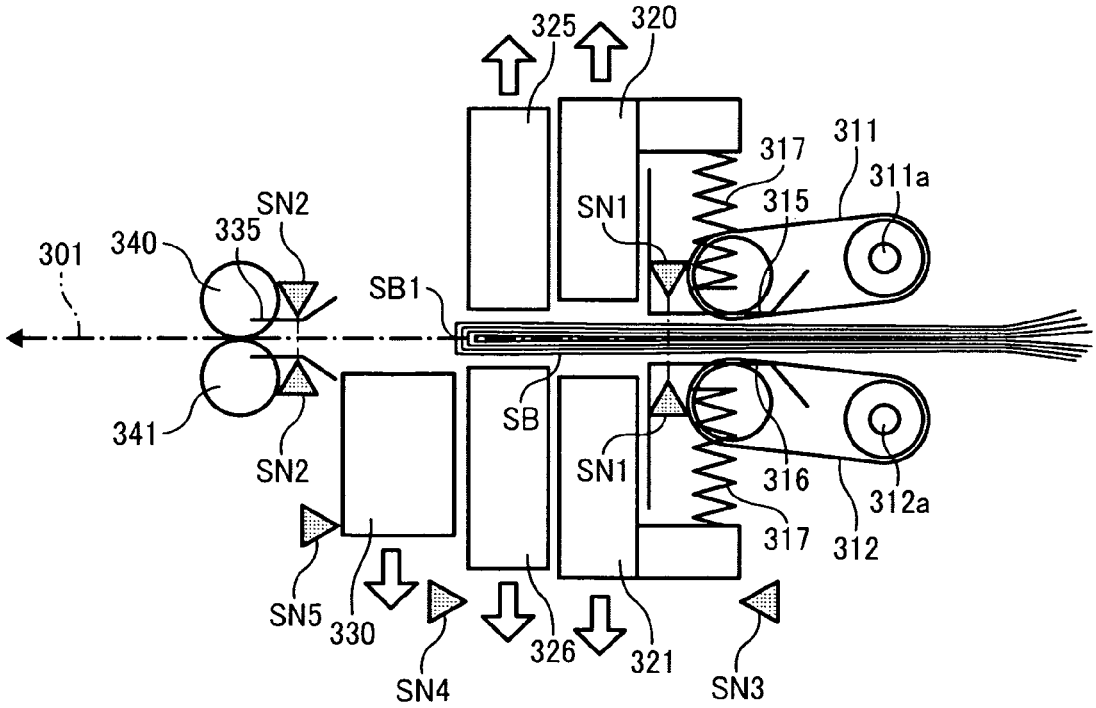
FIG. 16 illustrates completion of spine formation performed by the spine formation device in which the pair of auxiliary clamping plates and the pair of clamping plates are disengaged from the bundle of folded sheets.

Subsequently, as shown in FIG. 16, the auxiliary clamping plates 320 and 321 and the clamping plates 325 and 326 move away from the booklet SB to predetermined or given positions (standby positions), respectively. The contact plate 330 moves toward the home position and stops at a position where the top surface thereof guides the booklet SB.

Figure 17:
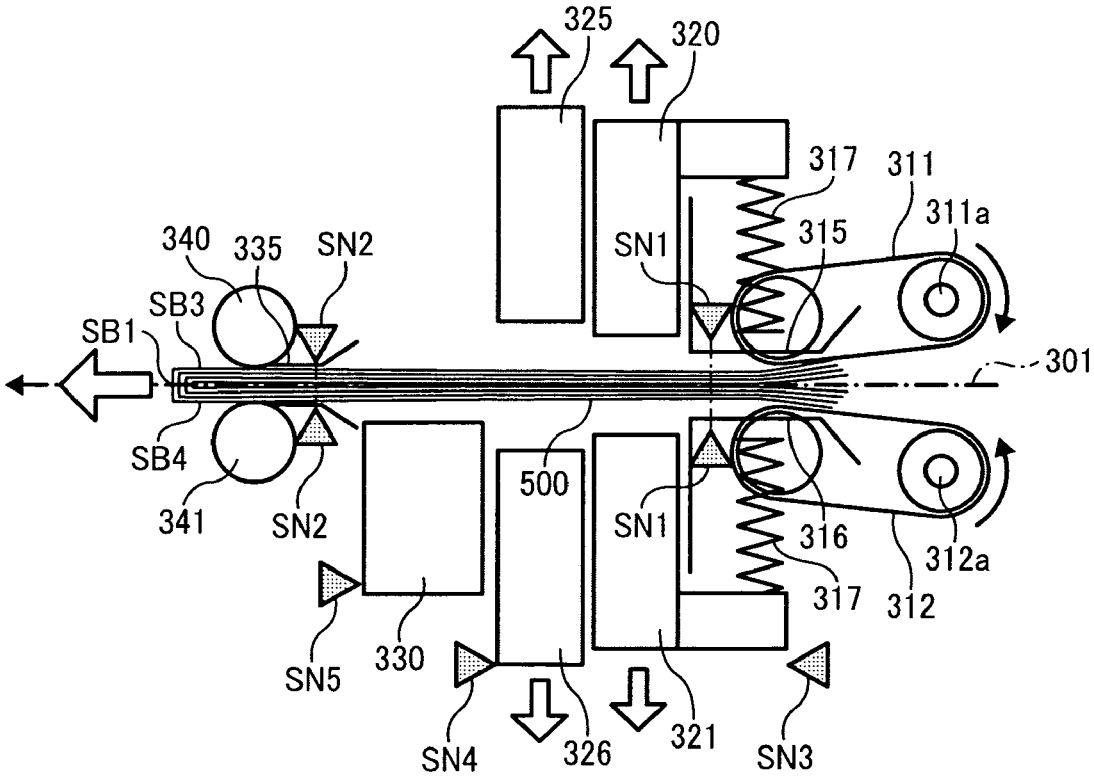
FIG. 17 illustrates a state in which the bundle of folded sheets is discharged from the spine formation device after spine formation.

After the auxiliary clamping plates 320 and 321, the clamping plates 325 and 326, and the contact plate 330 reach the respective standby positions, as shown in FIG. 17, the transport belts 311 and 312 and the pair of discharge rollers 340 and 341 start rotating, thereby discharging the booklet SB outside the spine formation device 3. Thus, a sequence of spine formation operations is completed. The transport belts 311 and 312 and the pair of discharge rollers 340 and 341 stop rotating after a predetermined time period has elapsed from the detection of the booklet SB by the discharge detector N2. Simultaneously, the respective movable portions return to their home positions. When subsequent booklets SB are sequentially sent form the bookbinding device 2, the time point at which the rotation of the transport belts 311 and 312 and the discharge rollers 340 and 341 is stopped is varied according to the transport state of the subsequent booklet SB. Additionally, it may be unnecessary to return the respective movable portions to their home positions each time, and the position to receive the booklet SB may be varied according to the transport state of and the data relating to the subsequent booklet SB. It is to be noted that the CPU 3-1 of the spine formation device 2 in the control circuit of the bookbinding system performs these adjustments.

A control block of the bookbinding system is described below with reference to FIG. 19.

As shown in FIG. 19, the control circuit of the bookbinding system enables the online bookbinding system. FIG. 19 is a block diagram illustrating a configuration of online control of the bookbinding system. The post-processing apparatus 1 is connected to the image forming apparatus (MFP) 100 including the engine 110, and the bookbinding device 2 is connected to the post-processing apparatus 2. Further, the spine formation device 3 is connected to the bookbinding device 2. The MFP 100, the post-processing apparatus 1, the bookbinding device 2, and the spine formation device 3 respectively include the CPUs 100-1, 1-1, 2-1, and 3-1. The MFP 100 further includes an engine 110 and a communication port 100-2. The post-processing apparatus 1 further includes communication ports 1-2 and 1-3, the binding device 2 further includes communication ports 2-2 and 2-3, and the spine formation device 3 further includes a communication port 3-2. The MFP 1 and the post-processing apparatus 1 can communicate with each other using the communication ports 100-2 and 1-2, and post-processing apparatus 1 and the bookbinding device 2 can communicate with each other using the communication ports 1-3 and 2-2. Similarly, the bookbinding device 2 and the spine formation device 3 can communicate with each other using the communication ports 2-3 and 3-2. Additionally, the CPU 100-1 of the image forming device 100 controls indications on the operation panel 105 and inputs from users to the operation panel 105, and thus the operation panel 105 serves as a user interface.

Each of the image forming apparatus 100, the post-processing apparatus 1, the bookbinding device 2, and the spine formation device 3 further includes a read-only memory (ROM) and a random-access memory (RAM). Each of the CPUs 100-1, 1-1, 2-1, and 3-1 thereof reads out program codes from the ROM, runs the program codes in the RAM, and then performs operations defined by the program codes using the RAM as a work area and a data buffer. With this configuration, various control and operations described above or below are performed. The MFP 100, the post-processing apparatus 1, the bookbinding device 2, and the spine formation device 3 are connected in line via the communication ports 100-2, 1-2, 1-3, 2-2, 2-3, and 3-2. When post-processing of sheets is performed online, the CPUs 1-1, 2-1, and 3-1 of the post-processing apparatus 1, the bookbinding device 2, and the spine formation device 3 communicate with the CPU 100-1 of the image forming apparatus 100, and thus the post-processing of sheets is controlled by the CPU 100-1 of the MFP 100.

It is to be noted that, in this specification, "inline processing" means that at least two of image formation, processing of sheets, stapling of a bundle of sheets, and spine formation of the booklet are performed sequentially while the sheets are transported through the bookbinding system. Additionally, the bookbinding and spine formation is performed in accordance with characteristic data of the booklet SB (i.e., sheet-related variables). The characteristic data of the booklet SB includes the quantity of sheets and sheet thickness at least and may also include sheet size and the type of sheets, that is, special sheet classification. When the characteristic data of the booklet SB includes the special sheet classification, the characteristic data includes data for distinguishing the type of special sheets among overhead projector (OHP) sheets, label sheets, coated sheets, sheets folded into special shapes, and perforated sheets.

Additionally, the CPUs 100-1, 1,1, 2-1, and 3-1, the storage device including the ROMs and RAMs (not shown) of the image forming apparatus 100, the post-processing apparatus 1, the bookbinding device 2, and the spine formation device 3, the operation panel 105 of the image forming apparatus 100 function as resources when spine formation is formed via computers.

Descriptions will be given below of determination of the predetermined conveyance distance of the booklet in accordance with a sheet-related variable.

Figure 20:
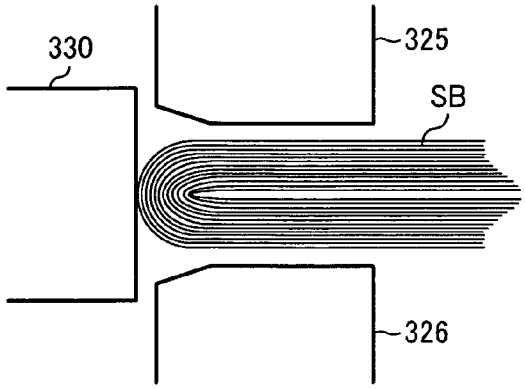
FIG. 20 is an enlarged view that schematically illustrates a state just before the booklet is pressed against the contact plate and squeezed by the clamping unit.
Figure 21:
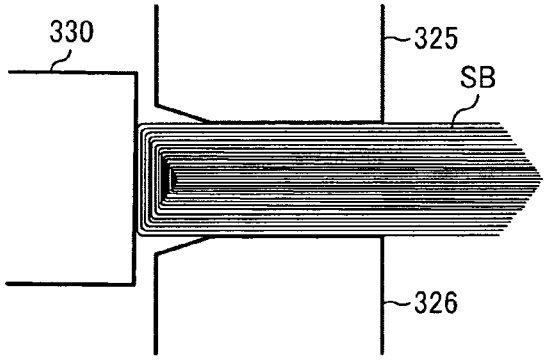
FIG. 21 is an enlarged view that schematically illustrates a state in which the predetermined amount of the booklet is pressed against the contact plate after the state shown in FIG. 20.

FIGS. 20 and 21 are enlarged views that schematically illustrate the relation between the booklet and the clamping unit. FIG. 20 and FIG. 21 respectively illustrate a state just before the booklet SB is pressed against the contact plate 300 and that in which the predetermined amount of the booklet SB is pressed against the contact plate 300 after the state shown in FIG. 20. It is to be noted that FIGS. 20 and 21 correspond to the state shown in FIG. 14 and that shown in FIG. 15 although the budging of the booklet SB is omitted. Additionally, FIG. 22 is a schematic view illustrating an outline of the booklet SB before spine formation and that after spine formation.

Figure 22:
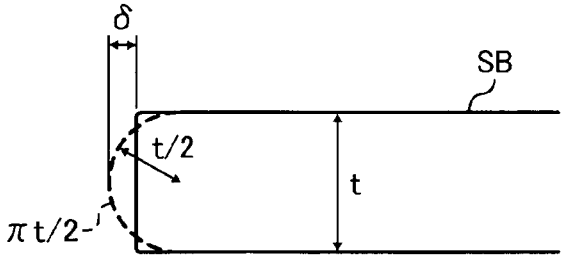
FIG. 22 is a schematic view illustrating an outline of the booklet before spine formation and that after spine formation.

Referring to FIG. 22, because a flat surface is produced by pressing the R-shaped folded leading edge portion of the booklet SB against the contact plate 300, the following formula can be obtained from a geometrical perspective. It is to be noted that, in FIG. 22, reference character δ represents the amount by which the leading edge portion of the booklet projects from the clamping unit in the sheet conveyance direction.

$$2(t/2-\delta\mathrm{def})+t=\pi t/2 \quad (1)$$

wherein t represents the thickness of the booklet SB (i.e., the bundle of folded sheets), δdef represents a default conveyance distance for spine formation (projection amount) for standard sheets, and π represents the circular constant.

From the above-described formula 1, the following formula can be obtained.

$$\delta\mathrm{def}=(1-\lambda/4)t \quad (2)$$

Thus, the predetermined conveyance distance for spine formation can be obtained from the thickness of the booklet SB.

More specifically, it is preferable that the predetermined distance by which the booklet SB is transported by the transport belts 311 and 312 for spine formation be equal or similar to the projection amount δ obtained by the formula described above.

Additionally, when Tdef and N respectively represent the sheet thickness of a standard sheet and the quantity of sheets, the thickness t of the booklet SB can be expressed by the following formula because the sheets are folded in two.

$$t=2\times T\mathrm{def}\times N \quad (3)$$

Further, from the above-described formulas 2 and 3, the following formula can be obtained.

$$\delta\mathrm{def}=(2-\pi/2)T\mathrm{def}\cdot N \quad (4)$$

In other words, the default distance δdef for spine formation for standard sheets can be set based on the thickness of standard sheets and the quantity of sheets in the booklet SB.

Because the projection amount δ increases as the quantity of sheets increases, by setting the default conveyance distance for spine formation δdef to the value equal or similar to the projection amount as described above, the spine of the booklet SB can be flattened reliably, with the bulging of the spine reduced and without damage to the spine, regardless of the thickness of the booklet or the quantity of sheets in the booklet.

Figure 23:
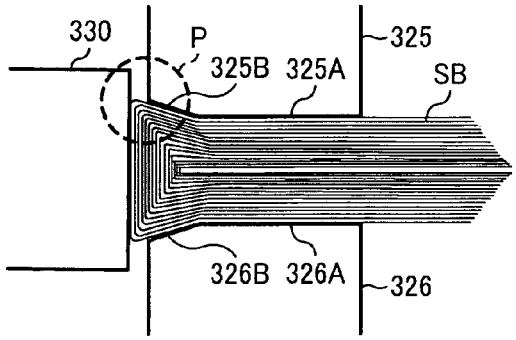
FIG. 23 is an enlarged view illustrating a main part of the clamping unit and the booklet in spine formation.

FIG. 23 is an enlarged view illustrating a main part of the clamping unit and the booklet SB in spine formation.

As it can be known from FIG. 23, when the booklet SB is clamped between the clamping plates 325 and 326, the greater the default conveyance distance for spine formation δdef is, the greater the amount by which the leading edge portion of the booklet SB projects from the surfaces of the clamping plates 325 and 326 on the downstream side in the sheet conveyance direction is. Accordingly, the leading edge portion of the booklet SB projects from the front cover and the back cover continuous with the spine by the amount corresponding to the increase in the default conveyance distance for spine formation δdef.

It is to be noted that, in FIG. 23, reference characters 325A and 326A represent the surfaces of the clamping members 325 and 326 that press against the booklet SB and hereinafter referred to as the pressing surfaces 325A and 326B, respectively. Additionally, as shown in FIG. 23, the pressing surfaces 325A and 326A of the clamping plates 325 and 326 are tapered on the downstream side in the sheet conveyance direction in directions away from each other, that is, the clamping plates 325 and 326 include sloped surfaces 325B and 326B formed on the downstream side of the pressing surfaces 325A and 326A in the sheet conveyance direction. With this configuration, as shown in the area P in FIG. 23, the corners of the spine of the booklet SB can have a higher degree of sharpness, thus forming the flat surface more reliably.

In the present embodiment, when the booklet SB is constituted of or includes thicker sheets than standard sheets, OHP sheets, or special sheets such as coated sheets, the pressed amount of the leading edge portion of the booklet SB is the sum of an additional distance δn and the default conveyance distance for spine formation δdef expressed by formula 2 (δdef+δn). With this adjustment, the spine of the booklet SB can be flattened more reliably. It is to be noted that n represents a given positive integer and the quantity of set values of the additional distance on can be n.

The additional distance δn is set in accordance with characteristics of the booklet such as the sheet thickness, the sheet size, the quantity of sheets in the booklet, the special sheet classification, and the like. More specifically, spine formation of booklets with different characteristics can be performed experimentally. Then, the additional distance δn can be set in accordance with the characteristics of the booklets based on the results of the experiment and stored in a table. When spine formation is performed actually, the additional distance δn corresponding to the characteristics of the specific booklet SB is retrieved from the table and then is added to the predetermined conveyance distance for spine formation calculated based on the thickness t of the booklet.

Additionally, the present embodiment enables manual setting of the additional distance δn by the user, in addition to automatic setting, because the predetermined default conveyance distance δdef and the additional distance δn may be improper if the user uses different type of sheets from the sheet types set in the apparatus. In other words, the user can select either the manual setting or automatic setting of the predetermined conveyance distance δ for spine formation.

The user can perform this selection via the operation panel 105 (an input unit) of the image formation apparatus 100. Alternatively, the operation panel 105 may be provided in the spine formation device 3, not in the image formation apparatus 100.

Figure 24:
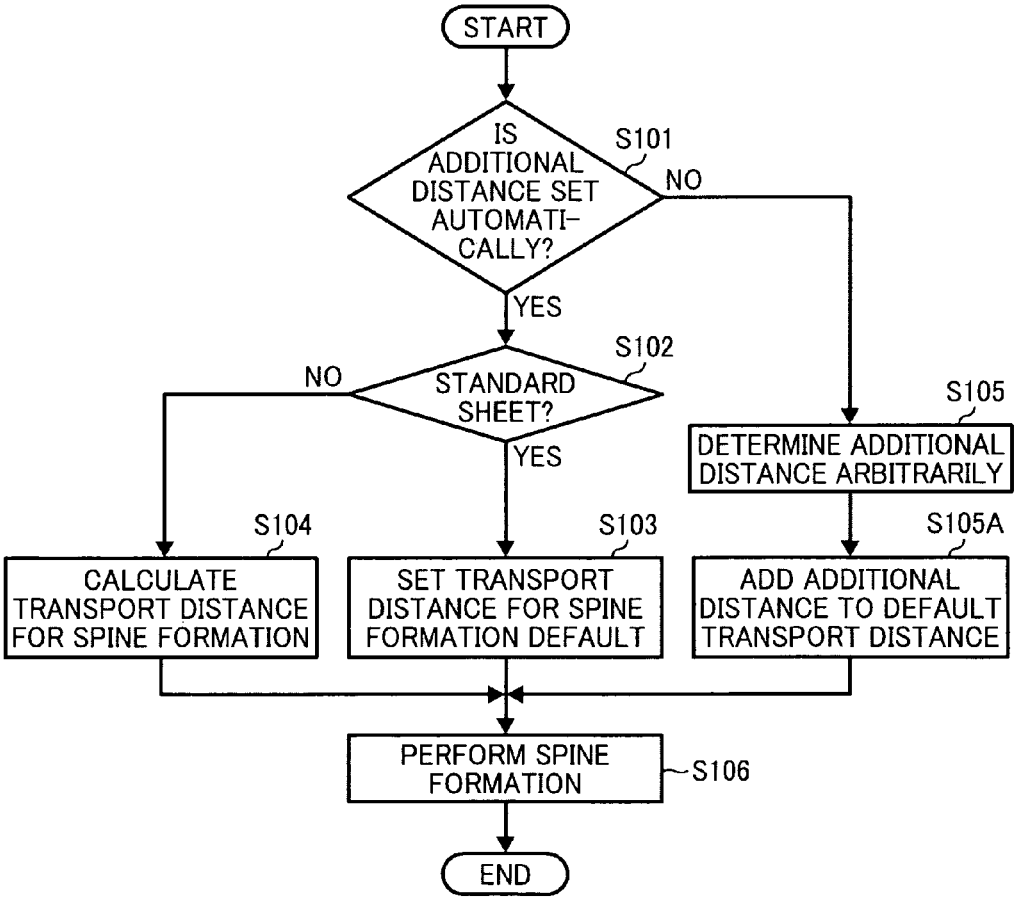
FIG. 24 is a flowchart illustrating a procedure of spine formation in which an additional distance corresponding to characteristics of the booklet is added to a pressed amount of the booklet calculated based on the thickness of the booklet.

FIG. 24 is a flowchart illustrating a procedure of control performed by the CPU 3-1 of the spine formation device 3.

Referring to FIG. 24, after a job that involves spine formation is started, at S101 the CPU 3-1 checks whether or not the additional distance δn is set automatically or set by the user. When the additional distance δn is set automatically (YES at S101), at S102, the CPU 3-1 checks whether or not the booklet SB is formed with standard sheets. When the booklet SB is formed with standard sheets (YES at S102), at S103, the CPU 3-1 sets the pressed amount of the booklet SB to the default conveyance distance δdef for spine formation expressed by formula 2. At S106, spine formation is performed, and the amount of the leading edge portion of the booklet SB thus set (δdef) is pressed against the contact plate 330.

By contrast, when the booklet SB is not formed with standard sheets (No at S102), at S104 the pressed amount of the booklet SB can be set in accordance with at least one of the sheet thickness, the sheet type (special sheet classification), the sheet size, and the quantity of sheets. More specifically, one of the multiple additional distances δn stored in the table is selected and added to the default conveyance distance δdef for spine formation. At S106, spine formation is performed, and the amount of the leading edge portion of the booklet SB thus set (δdef+δn) is pressed against the contact plate 330. From the multiple additional distance δn (quantity=n), which are set in accordance with characteristics of the booklet such as sheet thickness, sheet type (special sheet classification), sheet size, and the quantity of sheets in the booklet, a suitable one is selected.

When the additional distance δn is set manually by the user (No at S101), at S105 the user sets the additional distance δn arbitrarily, and at S105A the pressed amount of the booklet SB is set to the sum of the default conveyance distance δdef and the additional distance δn set by the user. At S106, spine formation is performed, and the amount of the leading edge portion of the booklet SB thus set (δdef+δn) is pressed against the contact plate 330. It is to be noted that, for example, the user can set the arbitrary additional distance δn via a numeric keypad in the operation panel 105 of the image formation apparatus 100.

It is to be noted that, although one of multiple predetermined additional distances δn is selected in accordance with characteristics of the booklet such as sheet thickness and sheet type (special sheet classification) in the description above, the additional distances δn may be calculated based on the characteristics of the booklet. For example, when T, S, N, and L respectively represent the sheet thickness, the sheet size, the quantity (number) of sheets, and the special sheet classification and α, β, γ, and θ respectively represent coefficients of them, the additional distance δn can be calculated based on the characteristics of the booklet using the following formula in which the sheet thickness T, the sheet size S, the quantity (number) of sheets N, and the special sheet classification L are multiplied by the coefficients α, β, γ, and θ, respectively.

$$\delta n=(\alpha T+\beta S+\gamma N+\theta L)\times A \tag{5}$$

wherein A represents a coefficient for calculating the additional distance.

When the sheets are special type of sheets, by applying formula 5 to formula 2, the increased conveyance distance for spine formation, to which the additional distance is added, can be expressed by the following formula.

$$\delta\text{def}+\delta n=\delta\text{def}+(\alpha T+\beta S+\gamma N+\theta L)A \tag{6}$$

Additionally, the user can adjust the additional distance δn arbitrarily at S105 when different type of sheets from the sheet type set in the apparatus are used. With this adjustment, the spine formation conditions can be set properly regardless of the sheet type or the number of sheets.

As described above, in the present embodiment, when spine formation is difficult because the sheets are thicker or the number of sheets is greater, the additional distance δn can be adjusted automatically, thereby adjusting the pressed amount or conveyance distance (δdef+δn) of the booklet for spine formation. Thus, spine formation can be performed reliably.

Additionally, when the user folds the bundle of sheets in two, spine formation can be performed reliably under more proper conditions by adjusting the additional distance δn in accordance with the sheet thickness, the number of sheets, or the like, thereby adjusting the pressed amount of the booklet.

Additionally, because the sheet conveyer (transport bents 311 and 312) transports the booklet the predetermined distance downstream from the contact position between the folded leading edge of the booklet and the contact member (contact plate 330) to cause the booklet to bulge, thus obviating the need to move the contact member in the direction opposite the sheet conveyance direction and the driving mechanism for it. Moreover, the driving force to drive the sheet conveyer can be smaller and accordingly the power consumption is reduced because the bulging of the booklet is created by the sheet conveyer in a relatively long portion between the sheet conveyer and the contact member in the sheet conveyance direction.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device for forming a spine of a bundle of folded sheets, the spine formation device comprising:

a sheet conveyer that conveys the bundle of folded sheets with a folded portion of the bundle forming a front end portion of the bundle;

a clamping unit disposed downstream from the sheet conveyer in a sheet conveyance direction in which the bundle of folded sheets is transported, for squeezing the folded portion of the bundle in a direction of thickness of the bundle;

a contact member disposed downstream from the clamping unit in the sheet conveyance direction and including a flat contact surface against which the folded portion of the bundle is pressed;

a controller comprising a CPU and operatively connected to the sheet conveyer as well as the clamping unit to cause the bundle of folded sheets to bulge by stopping the sheet conveyer after the bundle of folded sheets is transported a predetermined conveyance distance downstream in the sheet conveyance direction from a contact position between the contact member and the folded portion of the bundle, the predetermined distance set in accordance with a predetermined sheet-related variable, and to cause the clamping unit to squeeze a bulging portion of the bundle created between the sheet conveyer and the contact member with the folded potion pressed against the contact member; and an input unit via which a user selects whether the predetermined conveyance distance is set automatically or manually.

2. The spine formation device according to claim 1, wherein the clamping unit comprises:

a first clamping member; and a second clamping member disposed downstream from the first clamping member in the sheet conveyance direction, wherein the controller causes the first clamping member to localize the bulging portion of the bundle created between the sheet conveyer and the contact member to a downstream side in the sheet conveyance direction and causes the second clamping member to form the spine of the bundle by squeezing a bulging portion of the bundle created between the first clamping member and the contact member.

3. The spine formation device according to claim 1, wherein the predetermined sheet-related variable comprises at least one of a quantity of the folded sheets, a sheet thickness, a sheet size, and a special sheet classification.

4. The spine formation device according to claim 3, wherein the special sheet classification is data identifying the sheet as one of an OHP sheet, a label sheet, and a coated sheet.

5. The spine formation device according to claim 1, wherein the predetermined sheet-related variable comprises a thickness of the bundle of folded sheets.

6. The spine formation device according to claim 5, wherein, when the bundle of folded sheets is constituted of multiple standard sheets, the predetermined conveyance distance of the bundle from the contact position between the contact member and the folded portion of the bundle is calculated as $$\delta def=(1-\pi/4)t$$

wherein δdef and t represent the predetermined conveyance distance for a standard sheet classification and the thickness of the bundle, respectively.

7. The spine formation device according to claim 1, wherein the predetermined sheet-related variable comprises a quantity of the folded sheets, a sheet thickness, and a special sheet classification, and the predetermined conveyance distance of the bundle from the contact position between the contact member and the folded portion of the bundle is a sum of a distance set in accordance with a special sheet classification and a default conveyance distance for a standard sheet classification, calculated as $$\delta def=(2-\pi/2)Tdef-N$$

wherein δdef, Tdef, and N respectively represent the predetermined conveyance distance for standard sheets, a thickness of a standard sheet, and the quantity of sheets in the bundle.

8. The spine formation device according to claim 1, wherein the clamping unit comprises a pair of pressing members arranged in the direction of thickness of the bundle of folded sheets, on both sides of the bundle, the pair of pressing members each including:

a pressing surface pressed against one of opposed sides of the front end portion of the bundle; and a sloped surface disposed downstream from the pressing surface in the sheet conveyance direction, sloped in a direction away from the sloped surface of the other pressing member toward downstream in the sheet conveyance direction.

9. A bookbinding system comprising:

an image forming apparatus to form images on sheets of recording media; and a spine formation device for forming a spine of a bundle of folded sheets, the spine formation device comprising:

a sheet conveyer that conveys the bundle of folded sheets with a folded portion of the bundle forming a front end portion of the bundle;

a clamping unit disposed downstream from the sheet conveyer in a sheet conveyance direction in which the bundle of folded sheets is transported, for squeezing the folded portion of the bundle in a direction of thickness of the bundle;

a contact member disposed downstream from the clamping unit in the sheet conveyance direction and including a flat contact surface against which the folded portion of the bundle is pressed;

a controller comprising a CPU and operatively connected to the sheet conveyer as well as the clamping unit to cause the bundle of folded sheets to bulge by stopping the sheet conveyer after the bundle of folded sheets is transported a predetermined conveyance distance downstream in the sheet conveyance direction from a contact position between the contact member and the folded portion of the bundle, the predetermined distance set in accordance with a predetermined sheet-related variable, and to cause the clamping unit to squeeze a bulging portion of the bundle created between the sheet conveyer and the contact member with the folded potion pressed against the contact member; and an input unit via which a user selects whether the predetermined conveyance distance is set automatically or manually.

10. A spine formation method used in a spine formation device including a sheet conveyer, a clamping unit, and a contact member disposed, in that order, in a sheet conveyance direction in which a bundle of folded sheets is transported, the spine formation method comprising:

transporting the bundle of folded sheets with the folded portion of the bundle forming a front end portion of the bundle in the sheet conveyance direction;

causing the bundle of folded sheets to bulge by stopping the bundle of folded sheets after the bundle of folded sheets is transported a predetermined conveyance distance downstream in the sheet conveyance direction from a contact position between the contact member and the folded portion of the bundle of folded sheets; and forming a spine of the bundle of folded sheets by squeezing a bulging portion of the bundle of folded sheets created between the sheet conveyer and the contact member in the direction of thickness of the bundle with the folded portion pressed against the contact member, wherein the predetermined distance is set in accordance with a predetermined sheet-related variable; and wherein a user selects whether the predetermined conveyance distance is set automatically or manually via an input unit.

* * * * *